US008212484B2

(12) United States Patent
Zolezzi-Garreton et al.

(10) Patent No.: US 8,212,484 B2
(45) Date of Patent: Jul. 3, 2012

(54) INITIATION METHOD FOR ABNORMAL GLOW PLASMA DISCHARGE IN A LIQUID-PHASE MEDIUM AND APPARATUS FOR ITS IMPLEMENTATION

(75) Inventors: Alfredo Zolezzi-Garreton, Vina del Mar (CL); Oleg Abramov, Moscow (RU); Vladimir Abramov, legal representative, Moscow (RU)

(73) Assignee: Research and Innovation, Inc., Road Town, Tortolla (VG)

( * ) Notice: Subject to any disclaimer, the term of this patent is extended or adjusted under 35 U.S.C. 154(b) by 395 days.

(21) Appl. No.: 12/465,346

(22) Filed: May 13, 2009

(65) Prior Publication Data

US 2010/0039036 A1 Feb. 18, 2010

Related U.S. Application Data

(60) Provisional application No. 61/052,844, filed on May 13, 2008.

(51) Int. Cl.
*H01J 7/24* (2006.01)

(52) U.S. Cl. ..... 315/111.21; 315/326; 315/348

(58) Field of Classification Search ..... 315/111.21, 315/326, 344, 348
See application file for complete search history.

(56) References Cited

U.S. PATENT DOCUMENTS 5,068,002 A 11/1991 Monroe
5,116,482 A * 5/1992 Setoyama et al. ..... 204/298.08
5,565,737 A * 10/1996 Keane ..... 315/111.21
5,900,103 A * 5/1999 Tomoyasu et al. ..... 156/345.44
6,535,785 B2 * 3/2003 Johnson et al. ..... 700/121
6,835,523 B1 12/2004 Yamazaki et al.
7,067,204 B2 * 6/2006 Nomura et al. ..... 428/698
7,070,634 B1 7/2006 Wang
7,345,428 B2 * 3/2008 Turner ..... 315/111.21
2001/0018127 A1 * 8/2001 David et al. ..... 428/404
2004/0265137 A1 12/2004 Bar-Gadda
2006/0060464 A1 3/2006 Chang

FOREIGN PATENT DOCUMENTS

JP 2006273707 10/2006

* cited by examiner

*Primary Examiner* — Jason M Crawford
(74) *Attorney, Agent, or Firm* — Eric A. Hanscom; Todd J. Langford

(57) ABSTRACT

A method and apparatus for initiating and maintaining an abnormal glow volumetric sonoplasma discharge (VSPD). With certain parameters of the electrical discharge and of the intensity of elastic vibrations, it is possible to initiate VSPD within a cavitating liquid medium. The mechanism for the initiation of VSPD is related to the breakdown of gas phase microchannels formed by growth cavitation bubbles. The method for continuous processing uses elastic vibrations in the frequency range 1-100 kHz with enough intensity for the development of cavitation phenomena; these vibrations are introduced into the liquid phase working medium, and a source of direct, alternating, high frequency and ultrahigh frequency electric field in liquid provides the initiation and stable glow of VSPD. Resulting VSPD is characterized by volumetric glow in the frequency range of visible light and ultraviolet radiation in the entire cavitational-electric field and has a rising volt-ampere characteristic curve.

25 Claims, 32 Drawing Sheets

Figure 32

| Liquid Phase | Voltage, V | | Current During Glow Discharge, A | Current Density, $A/cm^2$ | Resistance, ohm |
|---|---|---|---|---|---|
| | Initiation | Stable Glow | | | |
| Water | 20,000 | 800 - 100 | 6 - 14 | 0.3 - 0.7 | 35 - 15 |
| Dodecane | 30,000 | 800 - 200 | 6 - 14 | 0.3 - 0.7 | 45 - 35 |
| Ethanol | 30,000 | 800 - 150 | 6 - 14 | 0.3 - 0.7 | 40 - 25 |
| HCl Solution | 10,000 | 500 - 50 | 10 - 50 | 0.5 - 2.0 | 10 - 5 |
| NaOH Solution | 10,000 | 500 - 50 | 10 - 50 | 0.5 - 2.0 | 10 - 5 |
| NaCl Solution | 10,000 | 500 - 50 | 10 - 50 | 0.5 - 2.0 | 10 - 5 |

Figure 33

| Liquid Phase | Vibration Amplitude $\xi_{mc}$ of Cavitation Threshold $P_c$, μm | Noise $P_n$ at Cavitation Threshold $P_c$, mV | Noise $P_n$ at 1.2 $P_c$, mV | Maximum Noise Level $P_{n\ max}$, mV | Vibration Amplitude $\xi_{ml}$ at Reaching $P_{n\ max}$, μm |
|---|---|---|---|---|---|
| Water | 2 | 5 | 10 | 80 | 10 |
| Dodecane | 3 | 5 | 7 | 70 | 12 |
| Ethanol | 1 | 5 | 7 | 70 | 12 |
| HCl Solution | 2 | 5 | 5 | 10 | 80 |
| NaOH Solution | 2 | 5 | 5 | 10 | 80 |
| NaCl Solution | 2 | 5 | 5 | 10 | 80 |

INITIATION METHOD FOR ABNORMAL GLOW PLASMA DISCHARGE IN A LIQUID-PHASE MEDIUM AND APPARATUS FOR ITS IMPLEMENTATION

CROSS REFERENCE TO RELATED APPLICATIONS

This application is a non-provisional utility application of U.S. Provisional Application No. 61/052,844, filed May 13, 2008, the entirety of which is hereby incorporated by reference.

STATEMENT REGARDING FEDERALLY SPONSORED RESEARCH OR DEVELOPMENT

This invention was not federally sponsored.

FIELD OF THE INVENTION

The proposed invention relates generally to the field of ultrasonic and plasma processes, and more specifically, toward a method for the initiation of volumetric sonoplasma discharge in liquid requiring substantially less energy than as taught by the prior art, and an apparatus for its implementation that can be used in different innovative technologies. It is connected to a method for the initiation of volumetric sonoplasma discharge in liquid, and an apparatus for its implementation, resulting as the discharge of plasma in a medium assisted by mechanical waves, which due to cavitation, gives it a volumetric characteristic. It is also connected to the application of sonoplasma discharge for the production of hydrogen and stimulation of chemical decomposition reactions.

HISTORY AND BACKGROUND OF THE INVENTION

Arc discharge in aqueous electrolytes (for example, welding under seawater), is widely used in engineering and construction, and is at present the only known form of stationary plasma discharge in liquid media. In recent years, such discharge was also used in different physicochemical studies and in the synthesis of various materials. The specific feature of arc discharge in liquid media is the localization of a plasma region near the electrode ends and a "falling" form of volt-ampere characteristic as illustrated in FIG. 1.

In a gaseous phase, different kinds of discharges can be implemented, the external manifestation and electrical parameters of which are connected with a wide range of technical characteristics for devices used in their implementation and a variety of elementary processes determining the conditions of current passage through gas. The essential feature of electric discharge development in the gaseous phase is a profound effect of the properties of the gas medium on the current passages through the gas.

Under usual conditions, the concentration of charge carriers (electrons and ions) in the gas is very low: a gas is a very good dielectric. For a gas to have a high electrical conductivity (as a result of ionization) it is necessary for a high quantity of charge carriers to be present, requiring in turn a great quantity of energy. Gases have a steady electric conductivity when there is equilibrium between the origination and disappearance of charges. Thus, to create a means by which high electrical conductivity in a gas can be achieved through substantially lower energy requirements than has been taught in the prior art is highly desirable.

If the rate of movement of electrical charges is proportional to the field strength, the conductivity of gas approximately obeys Ohm's law (FIG. 2, section a). With increasing field strength, the decrease of electrical charges begins to have an influence (FIG. 2, section b) because of the migration of the charges to the electrodes. Further increases of the electrical field strength result in a steep increase of current due to the start of collision ionization (FIG. 2, section c). In spite of the avalanche-like character of current increases, the existence of external ionizer(s) is needed to sustain the electrical discharge, and the discharge remains being as not self-sustained (region 1). Eventually, a point is reached where for each electron leaving the cathode, one or more electrons arrive at the anode, in a phenomenon known as breakdown discharge (glow discharge or plasma discharge). This causes a self-sustained electrical current from the cathode to the anode. However, the current state-of-the-art process requires a large amount of energy to reach this self-sustaining threshold. Since high energy requirements directly and indirectly decrease the overall economy of the model, the requirement of high energy is undesirable. Therefore, it is highly desirable to have a new process having low energy demand in which the transition from non self-sustained discharge to self-sustained discharge (glow discharge) would occur with a low-energy input.

Again referring to FIG. 1, which illustrates the prior art, the voltage-current characteristic curve for glow discharge preferably comprises three sections, referred to for the sake of clarity as subnormal section or subnormal mode (FIG. 2, section d), normal section or normal mode (FIG. 2, section e) and abnormal section or abnormal mode (FIG. 2, section f).

Further increase of current density on the cathode causes the appearance of electric arc, as well as a drastic change of the main characteristics of the discharge (FIG. 2, section g).

It should be noted that the appearance or threshold of discharges in the gas phase depends considerably on the pressure of the gas. Thus, in the case of a uniform field of breakdown voltage (self-maintained discharge initiation voltage) the threshold is determined by the product of pressure by the distance between the electrodes, according to Paschen's Law. Pachen determined that breakdown voltage is determined by the following equation:

$$V = \frac{a(pd)}{\ln(pd) + b}$$

where V is the breakdown voltage in Volts, p is the pressure in atmospheres, d is the gap distance in meters, and a and b are constants that depend upon the particular gas between the electrodes. Thus, in contrast to liquids, which are relatively incompressible, different forms of electric discharge can be implemented in gases by varying the pressure of the gas between the electrodes.

Moreover, when ultrasonic cavitation, a sort of "cold boiling" resulting from the creation and collapse of zillions of microscopic bubbles in the liquid caused by ultrasonic waves, is implemented within a liquid, its phase composition and physical properties abruptly change, which can lead to some specific features for the formation of electric discharges within the liquid. In the region of intense cavitation, a gaseous component is formed which represents a significant fraction of the liquid. Therefore it can be assumed that the conditions for electric breakdown into the cavitation region should become easier, and the initiation of different forms of discharge could start through use of this invention. By varying the parameters of an ultrasonic field, it is possible to influence the processes of plasma glow within a cavitating liquid.

The prior art has several examples of attempts to resolve this problem.

However, few patent applications or patents work in the abnormal mode. In abnormal mode, also known as abnormal glow, effectively all of the gas molecules must be ionized to provide charge carriers for the current. Typically, the gas molecules are ionized multiple times meaning that more than one electron has been freed for most of the gas molecules. This creates a relatively uniformly distributed plasma across the electrodes. A higher density (or pressure) of gas molecules, on the other hand, would lead to a normal mode, or normal glow discharge. In this region, fewer than all of the molecules are ionized. This creates a situation where plasma forms in a relatively small region between the electrodes. A plasma discharge of this type can lead to concentrated energy in a relatively small area and possibly lead to electrode damage. Therefore, it is preferable to work in the abnormal mode.

Those patent applications or patents that do work in the abnormal mode, like U.S. Pat. No. 5,068,002, to Monroe, do not use an electrode as the radiator, in the same way that the instant application uses it, whereby the current application discloses a very low energy consumption jointly with a very low voltage to initiate and maintains a volumetric discharge which generates operational advantages in term of achieving the goals of this application. Monroe describes an ultrasonic glow discharge surface cleaning apparatus for abrading contaminants from the surface of a work piece using plasma glow discharge.

For example, in US Patent Application 2004/0265137 A1 to Bar-Gadda, a method is proposed for hydrogen production from water or steam by means of plasma discharge excited in the UHF, radio- or low-frequency range, as well as with arc discharge. This application describes the injection of water molecules into plasma discharge.

U.S. Pat. No. 7,070,634 B1 A1 to Wang describes a plasma apparatus for converting a gaseous mixture of water vapor and hydrocarbons into hydrogen.

US Patent Application 2006/0060464 to Chang teaches a fluid phase contained in a reactor, within which electrodes (anode and cathode) are placed. A flow of gas bubbles is introduced or generated in the medium in the region adjacent to the cathode. The potential difference necessary for the initiation of glow discharge and for the ionization of gas molecules in the bubbles is applied between the cathode and the anode.

U.S. Pat. No. 7,067,204 to Nomura et al., describes an apparatus comprising an ultrasonic generator for creation of bubbles within a liquid, and a generator providing the excitation of electromagnetic waves in the liquid phase, for the implementation of the plasma discharge.

Japanese Application JP2006273707 to Shibata et al. relates to the publication, "Synthesis of amorphous carbon nanoparticles and carbon-encapsulated metal nanoparticles in liquid benzene by an electric plasma discharge in ultrasonic cavitation field," Ultrasonic Sonochemistry 13 (2006) 6-12, Institute of Multidisciplinary Research for Advanced Material (IMRAM), Tohoku University. This application illustrates a method and a device for producing a nanocarbon material that does not require an expensive production facility such as the ones normally required for dry treatment. It can easily produce the nanocarbon material because the application of high voltage is not needed and neither worsens nor deteriorates the working environment in a production premise, and at the same time considers safety factors. This method can remarkably reduce production costs by improving production efficiency because of its continuous production and recovery, and providing an alternative for mass productivity. The method comprises a process (A) for arranging electrodes, one cathode and one anode, connected to the power source; an ultrasonic horn connected to an ultrasonic generator within an organic solvent that fills a container; and a process (B) for generating an ultrasonic cavitation field by ultrasonic waves into the organic solvent, around the head of the ultrasonic horn; and effecting the thermal decomposition of the molecules in the organic solvent by applying a voltage to the electrodes so as to generate plasma discharge within the ultrasonic cavitation field adequate for the production of the nanocarbon material.

U.S. Pat. No. 6,835,523 to Yamazaki et al. describes a "Method for fabricating with ultrasonic vibration a carbon coating," which is a process for fabricating a carbon coating in a medium disposed on one side of an electrode connected to a high-frequency power supply. Ultrasonic vibrations are then supplied to the object.

None of the prior art, however, either individually or in combination, provides a method by which initiating and maintaining an abnormal glow volumetric sonoplasma discharge can be performed using a substantially lower amount of electrical power.

Thus there has existed a long-felt need for a method by which the sonoplasma discharge can be initiated and maintained with substantially less electrical power than is currently needed to accomplish the same result using the prior art. This is accomplished with this invention.

The current invention provides just such a solution by having a method and apparatus for initiating and maintaining an abnormal glow volumetric sonoplasma discharge (VSPD). With certain parameters of the electrical discharge and of the intensity of elastic vibrations, it is possible to initiate VSPD within a cavitating liquid medium. The mechanism for the initiation of VSPD is related to the breakdown of gas-phase microchannels formed by the growth cavitation bubbles. The method uses elastic vibrations (EV) in the frequency range 1,000-100,000 Hz with enough intensity for the development of cavitation phenomena; these vibrations are introduced into the liquid-phase working medium, and a source of direct, alternating (hertz and kilohertz range), high frequency (HF) (megahertz range) and ultrahigh frequency (UHF) (gigahertz range) electric field in liquid (DPS) provides the initiation and stable glow of VSPD. Resulting VSPD is characterized by volumetric glow in the frequency range of visible light and ultraviolet radiation in the entire cavitation-electric field, and is characterized by a rising volt-ampere characteristic curve.

When a high-intensity ultrasonic field exceeding a cavitation threshold is induced within liquids, a new form of electric discharge is obtained, characterized by a volumetric glow electrical discharge throughout the space between the electrodes, having a rising volt-ampere characteristic curve that is inherent to abnormal glow discharge in gas. Such discharge within the liquid has the surface characteristic of micro bubbles, and can be used for the design of novel sonoplasma-chemical processes because of the extensive interface plasma. The heterogeneous liquid/gas-vapor system leads to a rise in diffusion rates of chemically active particles in the system and a more economical method to achieve the desired result(s).

BRIEF DESCRIPTION OF THE INVENTION

The invention discloses a volumetric sonoplasma discharge, which can be used to accomplish a number of commercially valuable process, including decomposing water, producing hydrogen, producing stable organic compounds, toxic and innocuous, production of gases, wastewater treatment and desinfection, stimulation of oxidation-reduction ("redox") reactions, reduction of oxide and sulfide compounds to their metals, production of pure metals and alloys in the form of nanosized powders, and metal coatings.

Among the distinctive features of this invention are:

1. A new plasma state, due to the operating ranges used, obtained within a liquid by means of a combination of electrical and acoustic fields that can be classified into the category of sonoplasma, according to the previous art (see, for example, Nomura);

2. A method for continuous processing of liquids in a regime of abnormal plasma discharge, according to the voltage-current conditions specified in the method;

3. A volumetric character for the electrical discharge, this character obtained by the interaction of an electrical field and an acoustic field;

4. A continuous quality of the electrical discharge obtained through the interaction of an electrical field and an acoustic field;

5. The generation of low-voltage (for example, 20 V) plasma;

6. The design and application of a sonoelectrode; and,

7. The production of plasma with low-energy demand, for stimulation of physical-chemical processes in liquids.

The present invention provides a synergistic influence between elastic vibration and electrical effects, both of them having strictly determined parameters and adequate sequences of actions within a liquid-phase system.

The method comprises the initiation and development of a volumetric sonoplasma discharge (VSPD) within a liquid-phase system that is the working medium. This initiation is achieved by cavitation, obtained by exceeding the level of certain characteristic of a chosen working medium, with a simultaneously applied electrical field of enough strength to break down a cavitating liquid-gas-vapor medium. After the breakdown is accomplished, the plasma glow discharge is self-maintained and stable because of the conditions chosen. These conditions are simultaneously generated within the working medium within the interelectrode space. To this end, the VSPD initiation is done in the following steps: ultrasonic cavitation is produced within the working medium; an ignition-voltage pulse is applied sufficient to break down the working medium, and finally applying a voltage adequate to create a stable-glow plasma.

The described task is performed under the implementation of the following conditions: An electric voltage is applied into the interelectrode space, with frequencies in a preferred range of 1 to 100 kHz of intensity, which research has show to be sufficient to cause cavitation in the medium, the level of the cavitation noise being within the frequency range of 1-1000 kHz, and in a particularly preferred embodiment, not less than 1.2 times the cavitation threshold in the reaction zone (at 10 mm, or 0.4 in, from the radiating surface of a waveguide, or the exit section of a hydrodynamic radiator) for the working medium used. This electric voltage is applied to the electrodes within the working medium after the ignition pulse is applied to them, and is sufficient for the electric breakdown of the working medium. The electric voltage has characteristics in a preferred embodiment that range from 100 to 2000 V, direct or alternating (50-100,000 Hz), in order to achieve the stable glow of VSPD. Also, electromagnetic radiation can be used in the HF range (10-20 MHz) or UHF range (2-3 GHz), of an intensity sufficient to disrupt the working medium and for glowing the plasma discharge. Polar liquids are used as working media (such as water, hydrocarbons, alcohols and other organic compounds or solutions thereof) with electrolytes having pH values from 0 to 14 (acids, alkalis and their solutions, salt solutions), heterogeneous systems of liquid-vapor gas bubbles of a size larger than $10^{-6}$ centimeters (~$3.94\times10^{-7}$ in), emulsions (such as water -hydrocarbon compounds), suspensions of solid particles (for example, in water) with sizes larger than 0.1 μm, and colloidal dispersions (such as solids with particle sizes less than 0.1 μm in water). In these mixtures, the content of the dispersed phase (bubbles of vapors or gas, drops of the dispersed liquid phase, or solid-phase particles) in the working medium in a preferred range of 1 to 50%; the initiation pulse voltage is in the range of 0.5 to 30 kV, with a duration from 0.1 to 100 microseconds. The treatment of the working medium by elastic vibrations (EV) can be conducted at one frequency, or simultaneously at several frequencies, in the range specified above. EV treatment and the initiation of plasma discharge are performed in constant or pulsed mode, and are carried out with constant and/or varying acoustic and/or electric parameters and/or technological characteristics of the process being conducted. For excitation of VSPD, the temperature of the working medium is held constant in a preferred temperature range of $1.05\,T_s$-$0.8\,T_b$ (where $T_s$ is the solidification temperature and $T_b$ is the boiling point of the liquid) or is varied according to the regime determined specifically for the technological process. Also, the temperature of the electrode is held constant or is varied according to the demands for the specific technological process. Additionally, the pressure in the reactor containing the working medium is held within a range of 0.01-20 atm (0.15-294 PSI) or is varied according to the demands of the specific technological process. Furthermore, the electrical and acoustic parameters of the VSPD implemented in a working medium are varied according to the demands of the specific technological process.

The development of an apparatus for VSPD excitation within a liquid-phase working medium is achieved with a reaction chamber (a reactor) and sources of electric field (EFS) and EV within the working medium, and is characterized by the EFS source preferably comprising two units: one to supply the voltage for the ignition pulse, and the other to supply the VSPD stable-glow voltage. There is also a radiating section (radiator) for a vibratory source, where this source includes an electroacoustic or a mechanoacoustic transducer. The above system is immersed into the reactor, where the reactor is full of working medium. For the operation of the system, following relationships among distances between the designed elements for the excitation of an electric field within a liquid phase (in particular, kind of electrodes and diameter of induction coil, $L_e$ and $D_i$, respectively), a radiator length $L_{ei}$ and the reaction zone length $L_R$, as well as the diameter and length of the radiator $d_l$ and $L_l$. These parameters conform to following conditions:

$$L_e(D_i)\cong L_{ei}\cong L_c$$

$$L_R\cong 1.2L_l(d_l)$$

In this equation, $L_c$ is the parameter characteristic for the dimensions of the cavitation region (its extension into the liquid from the radiator), and $$L_c\cong(1.2\text{-}1.5)\lambda_{EV}$$

where $\lambda_{EV}$ is the wavelength of EV propagating within the working medium. The relational character "≅" refers to the two associated expressions as being equal or approximately equal.

The described task is solved with the implementation of the following design features: Electrodes are made, preferably, mainly in the form of rods of equal or different geometric configuration, and can be manufactured with the same or different conducting materials, such as graphite, tungsten, titanium, and copper. The axes of rod electrodes can be collinear or can form an angle. At least one of the electrodes preferably has the form of a tube and serves as a structural component of the reaction chamber. At least one of the electrodes preferably also serves simultaneously as a radiator; radiators can have the form of several rods, mainly of the same type, placed in order or arbitrary sequences. One radiator can be manufactured totally or partially from the same material as at least one of the electrodes. At least one of the radiators can serve as a structural component of the reaction chamber. An electro acoustic transducer, such as one of magnetostrictive type, can be used as the EV source, operating in the frequency range of 5-40 kHz, or a piezoceramic transducer operating in the frequency range of 20-100 kHz. Alternatively, a mechanoacoustic radiator, such as one of the hydro- or gas-dynamic type, can be used as the EV source operating in the frequency range of 1-20 kHz. An apparatus for VSPD excitation can be based on a reaction chamber of flow or batch type having means for withdrawal of a gas phase and/or for collection of a solid-phase sediment or with means adequate for coating onto a support, as which the surface of an electrode and/or radiator can serve. At least one of the components of the reaction chamber can be manufactured from a non-conducting material. In fact, this non-conducting material can be a fluorine-based plastic material. Additionally, an apparatus for VSPD excitation can be provided with means for changing and/or regulating the location of at least one of the electrodes and/or a radiator. An apparatus for VSPD excitation can also be provided with means for control and regulation of acoustic and electric parameters. The source of power for the ignition pulse of VSPD can include a battery of capacitors or a high-voltage source of other types that provide the potential difference between the cathode and anode, and a pulse with a sufficient duration for breaking down the layer of a liquid-vapor-gas working medium within the interelectrode space (0.5-30 kV with a pulse duration in the range 0.1-100 μs). To provide a stable glow of VSPD, a source of direct or alternating (50-100,000 Hz) current can be used to supply the voltage between the anode and cathode in the range 30-2,000 V, or for generation of electromagnetic radiation in the interelectrode space in the HF (10-20 MHz) or UHF (2-3 GHz) frequency range with sufficient intensity to electrically breaking down the working medium and produce the glow of plasma discharge.

BRIEF DESCRIPTION OF THE DRAWINGS

FIG. 32 is a table showing the electrical characteristics of VSPD within certain liquids.

FIG. 33 is a table showing the specific features of cavitation development in certain liquids.

DETAILED DESCRIPTION OF THE FIGURES AND THE INVENTION

Figure 1:
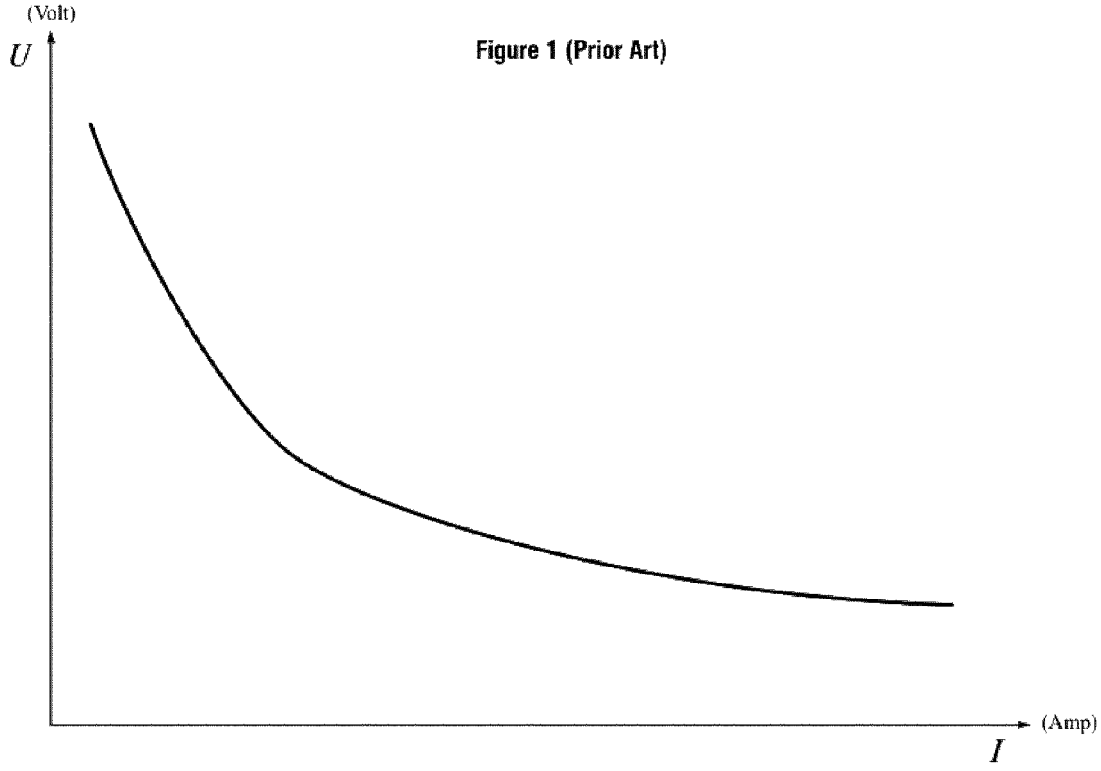
Figure 1 (Prior Art)
FIG. 1 is a schematic representation of a voltage-current characteristic curve of an arc discharge in liquid (prior art).
Figure 2:
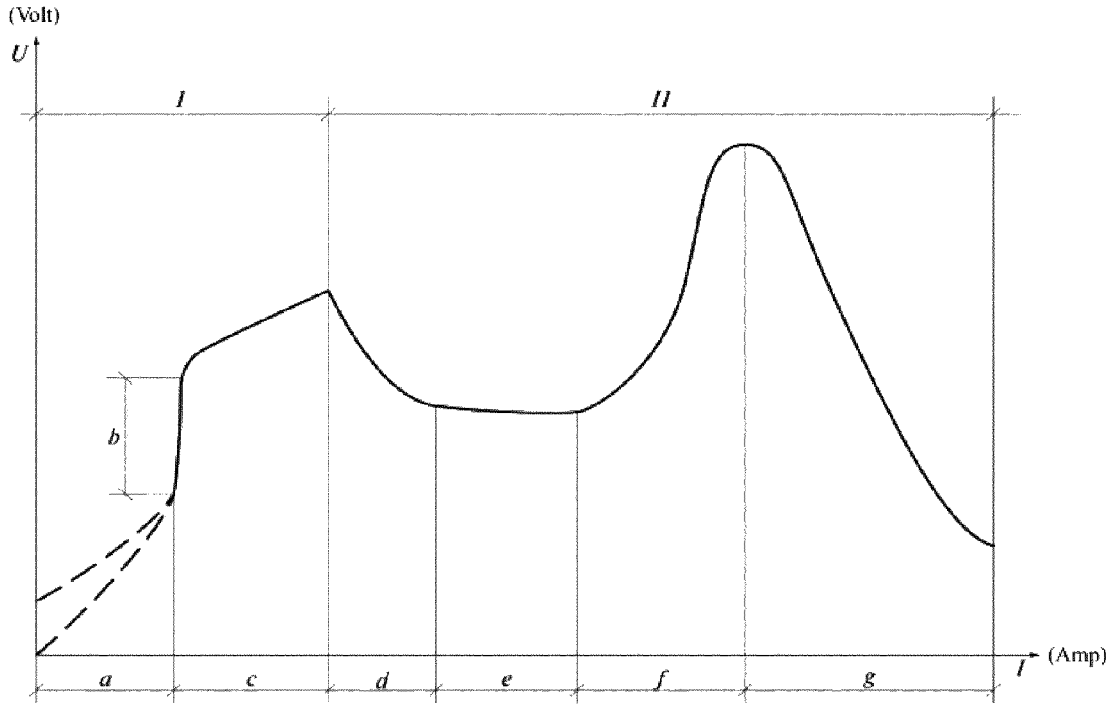
Figure 2 (Prior Art)
FIG. 2 is a schematic representation of a voltage-current characteristic curve for discharge in gases (prior art).

Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

Figure 3:
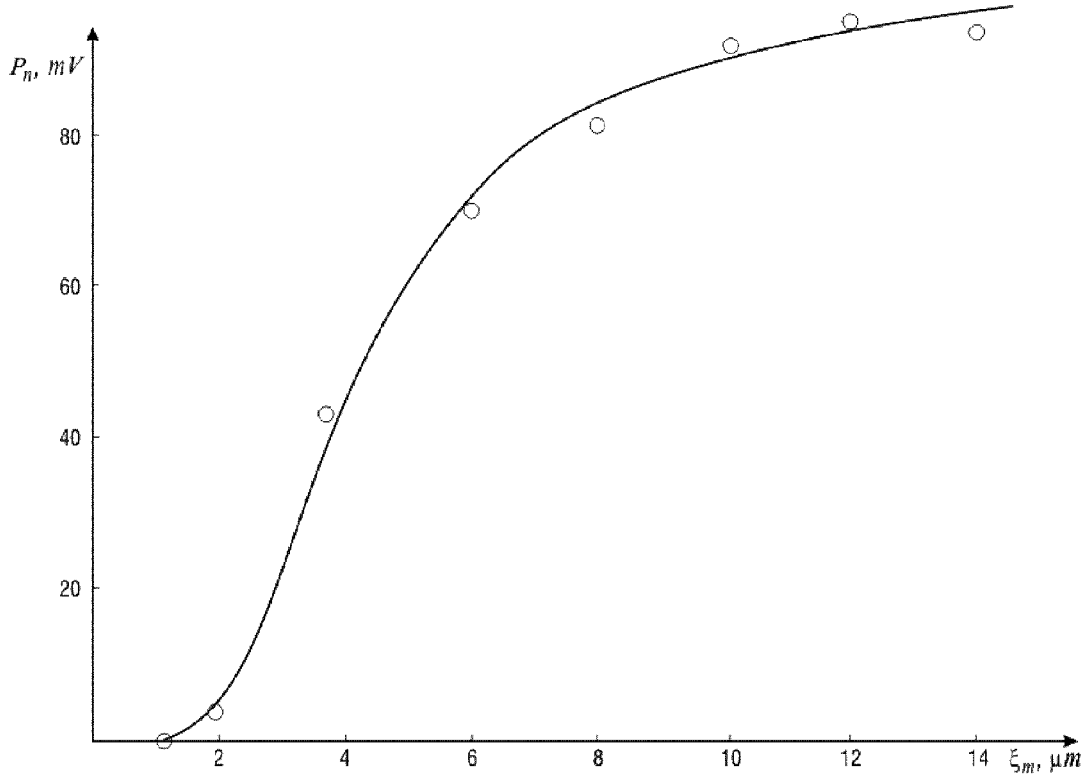
Figure 3 (Prior Art)
FIG. 3 illustrates the dependence between the level of cavitation noise and the amplitude of radiator vibration (prior art).
Figure 4:
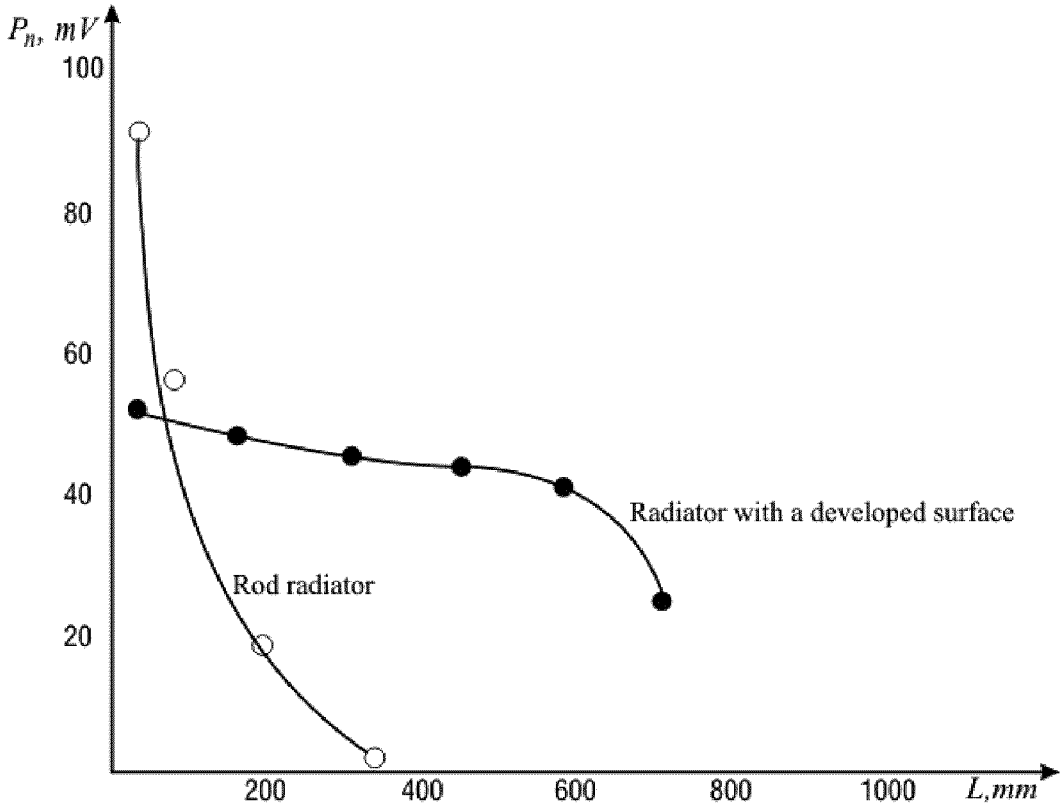
Figure 4 (Prior Art)
FIG. 4 illustrates the dependence between the level of cavitation noise and the distance from the radiating surface (prior art).

In order to ascertain the design formulas for the proposed method and apparatuses, erosion tests were performed with different liquid working media. The analysis of the features for development of cavitation showed that the level of cavitation noise increases with a rise in the amplitude of vibration of the sonotrode radiating surface, up to a certain value determined by the liquid properties. Afterwards, it remains practically constant (FIG. 3). The level of cavitation noise decreases with increasing distances from the radiator surface; the decrease is steeper when using a rod radiator when compared with a radiator that has a developed radiating surface (FIG. 4).

Figure 5:
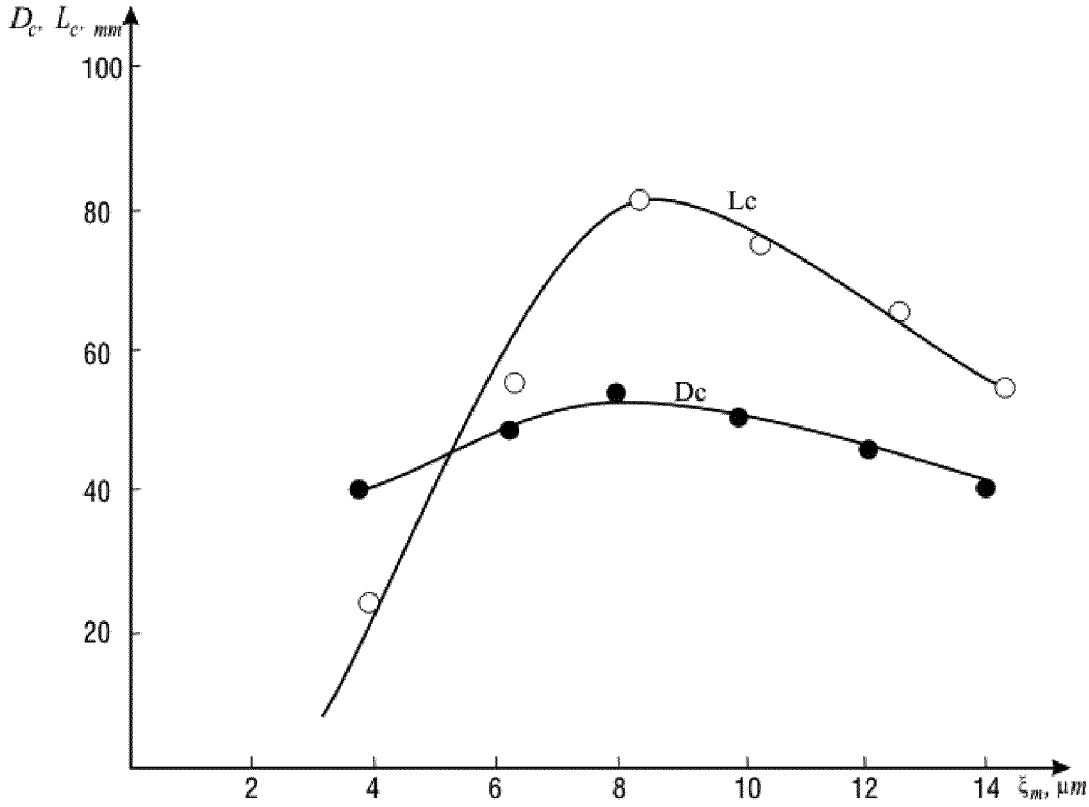
Figure 5 (Prior Art)
FIG. 5 illustrates the dependence between the size of the cavitation region and the vibration amplitude of the radiator (prior art).

Estimates of the dimensions ($D_C$, $L_C$—diameter and depth into the liquid phase, respectively) of the cavitation region, according to the erosion tests, showed that in the field of a rod-type radiator (FIG. 5) the following relations are met:

$$D_C \cong 1.2 d_l$$

$$L_c \cong (1.2\text{-}1.3)\lambda_{EV}$$

Where:

$d_l$=radiator diameter, $\lambda_{EV}$=wavelength of EV that propagates in a working medium.

When a sonotrode with a developed radiating surface is used, the depth of the cavitation region into the liquid phase ($L_{cd}$) can be described in the following way:

$$L_{cd} \cong (1.4\text{-}1.5)\lambda_{EV}$$

The invention is illustrated by drawings showing schemes of possible embodiments of assemblies that operate in the ultrasonic frequency range, and at one frequency, as shown in FIGS. 6-18. The invention is also illustrated by the analysis of the VSPD electrical and optical characteristics, obtained in experimental studies with different liquid-phase systems, as shown in FIGS. 19-33.

Figure 6:
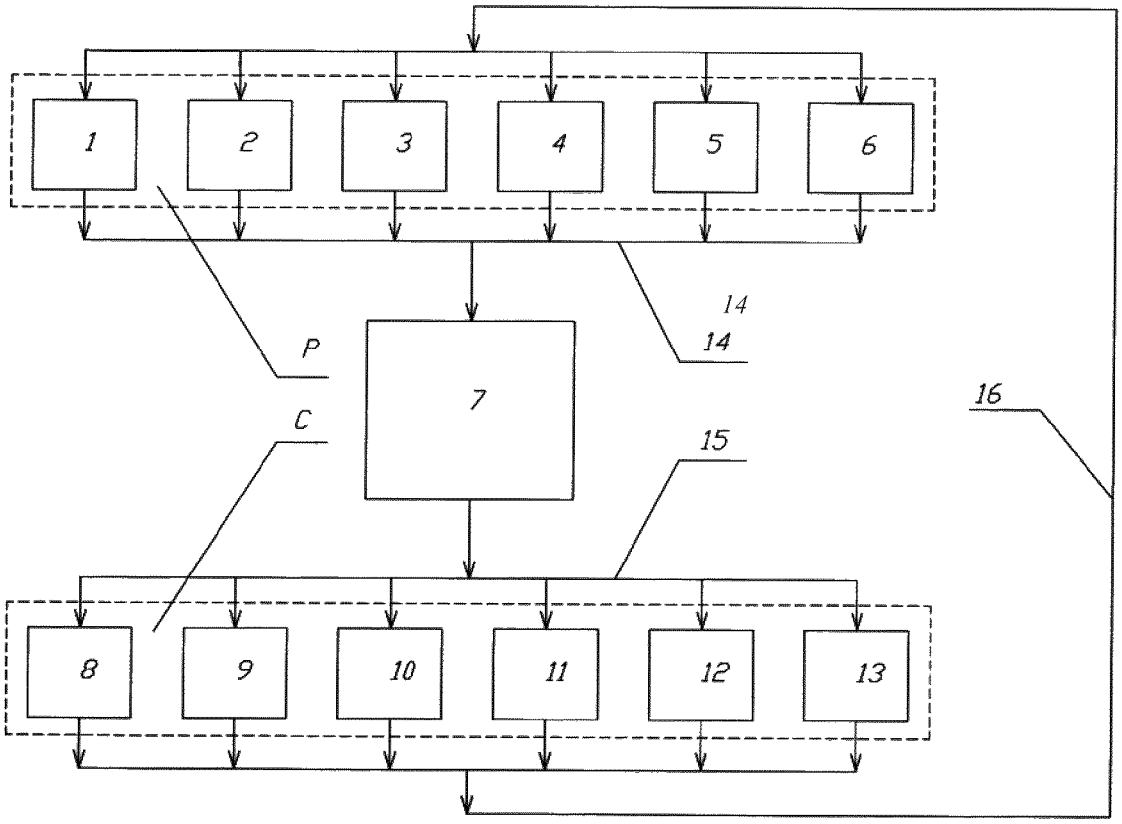
FIG. 6 shows a schematic diagram of an example of setup for VSPD initiation.

FIG. 6 shows a block diagram of an installation for initiation of VSPD within a liquid-phase working medium. The installation comprises reactor (7), a system for providing a technological process (P) and system for controlling the technological process (C).

The P system comprises EFS sources for discharge initiation (1) and for glow discharge (2), a source of EV excitation (3), a temperature controller (heating or cooling) for the process (4), a source of the necessary pressure (vacuum pumps, compressors) within the reactor (5), and sources of flow with appropriate characteristics (supply of liquid phase-pumps, withdrawal of gas and solid phases) for the VSPD process (6).

The system C comprises a unit for controlling the electric parameters in the process (8), a unit for controlling the optical and spectral parameters in the process (9), a unit of the control of process acoustic parameters (10), for controlling the temperature of the liquid phase (11), a reactor pressure controller (12), and a controller for the flow of liquid phase and the amount of gas phase formed (13).

Also, the installation is fitted with controls that maintain the appropriate conditions for a technological process (14), the control of the parameters of VSPD process (15), and the control of the technological process (16).

Figure 7:
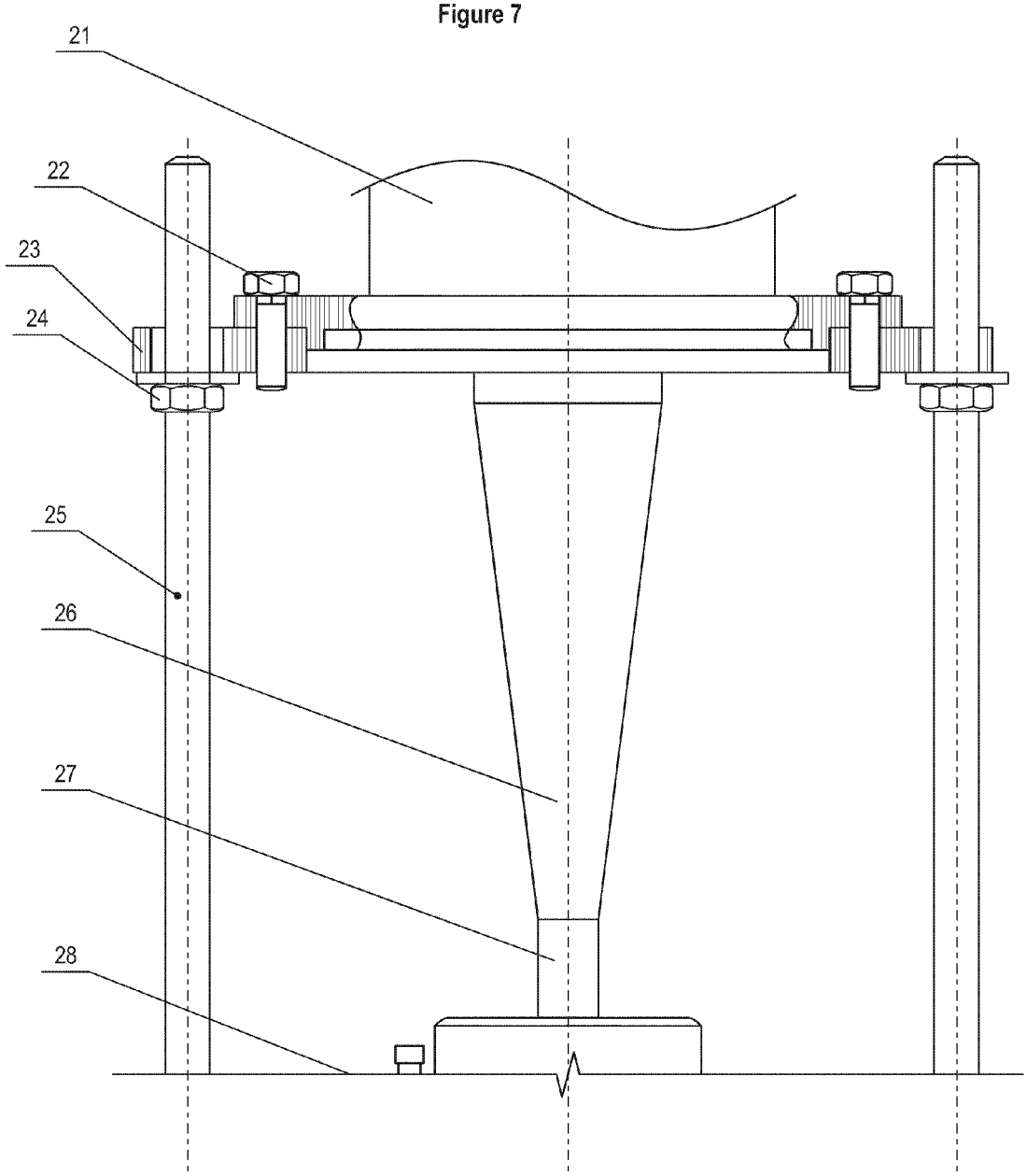
FIG. 7 shows a layout drawing of a reactor with the EV electro acoustic transducer unit.

FIG. 7 shows a diagram of the reactor and the electro acoustic transducer, source of EV.

Reactor (28) is mounted to guides (25) and is able to move vertically along the four guides (25) during the installation of the assembly. A vibration source comprising the magnetostrictive transducer (21), waveguide (26) and radiator (27) is fixed on plate (23) by the bolts (22). The plate location is adjusted with the nuts (24). The ultrasonic radiator (27) enters into the reactor (28). The cables for connecting the electrodes in the reactor to the EFS are not shown in the figure.

Figure 8:
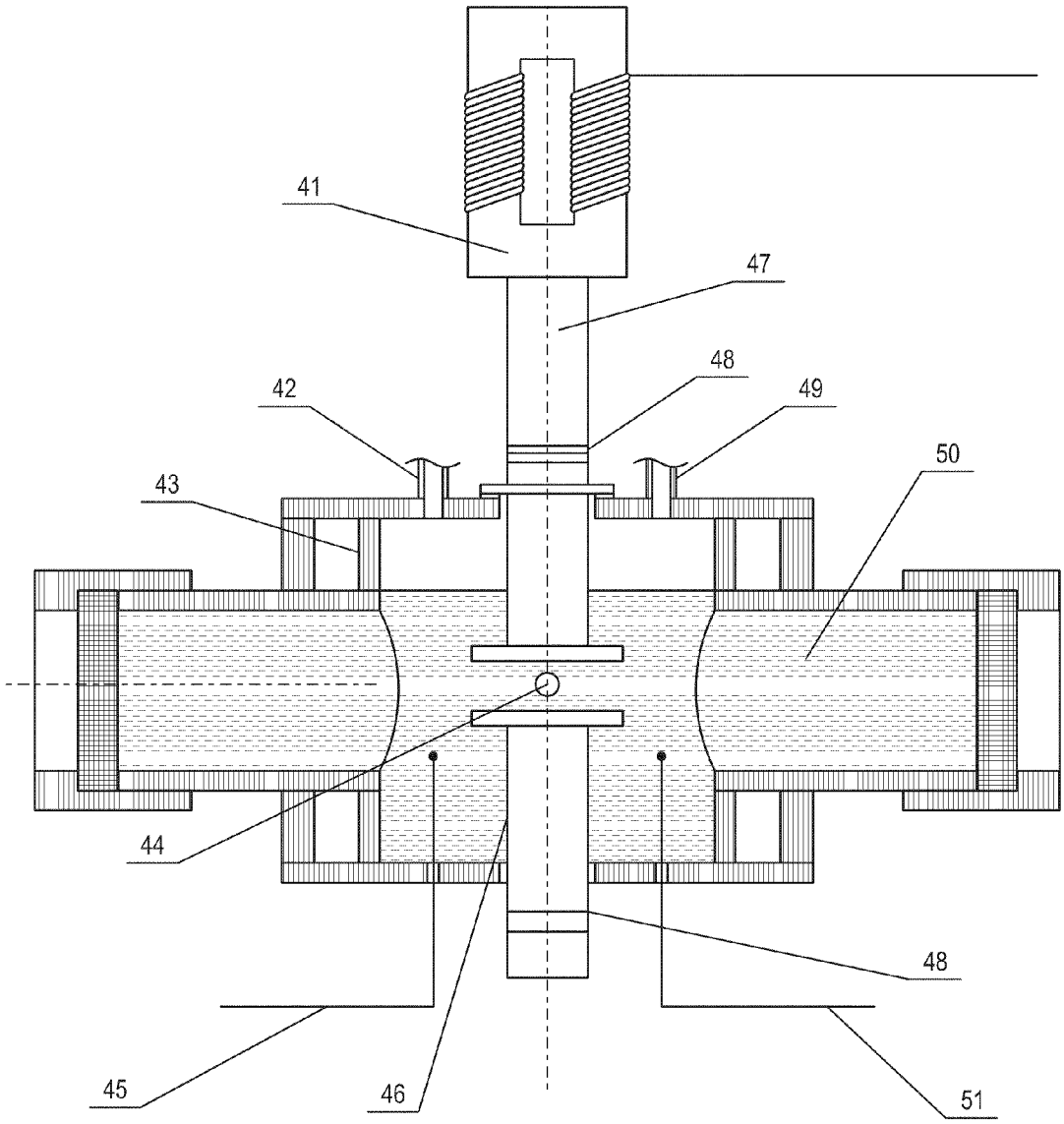
FIG. 8 shows a reactor for the initiation of VSPD within non-conducting (polar) liquids fitted with an electro acoustic transducer as a source of EV.

FIG. 8 shows a scheme of a reactor for the triggering of VSPD within non-conducting (polar) liquids using electro acoustic (magnetostrictive) transducers as sources of EV.

This assembly is based on a water-cooled reaction chamber (43). The chamber can be, optionally, provided with windows for observation of the visible plasma glow discharge processes (in the optical range). The discharge electrodes (46 and 47) are introduced into the chamber. The upper electrode (47) is simultaneously a waveguide of a vibration system, which also includes an electro acoustic transducer (41) of a magnetostrictive type. The power supply for the transducer is preferably an ultrasonic generator (item 3, FIG. 6). The power supply for sonoplasma discharge is connected to the discharge electrodes (46, 47) (item 2, FIG. 6). In this setup, the mounting is also provided for the rod electrodes (44) for triggering the arc discharge and is connected to the power supply (item 1, FIG. 6). The gaseous reaction products are withdrawn through a first nipple (42).

The assembly also includes a means for controlling electrophysical (item 8, FIG. 6) and acoustic characteristics: a sensor for the level of cavitation noise within the liquid phase (51) and a cavitation meter (item 10, FIG. 6). The chamber is also fitted with a sensor of liquid phase temperature (45). Current-supply wires (48) are connected to the discharge electrodes (46, 47). On the chamber cover, there is a second nipple (49) for connecting the reactor to a vacuum system, or to a system for increasing the pressure in the reactor. The chamber is filled with a liquid-phase working medium (50).

Figure 9:
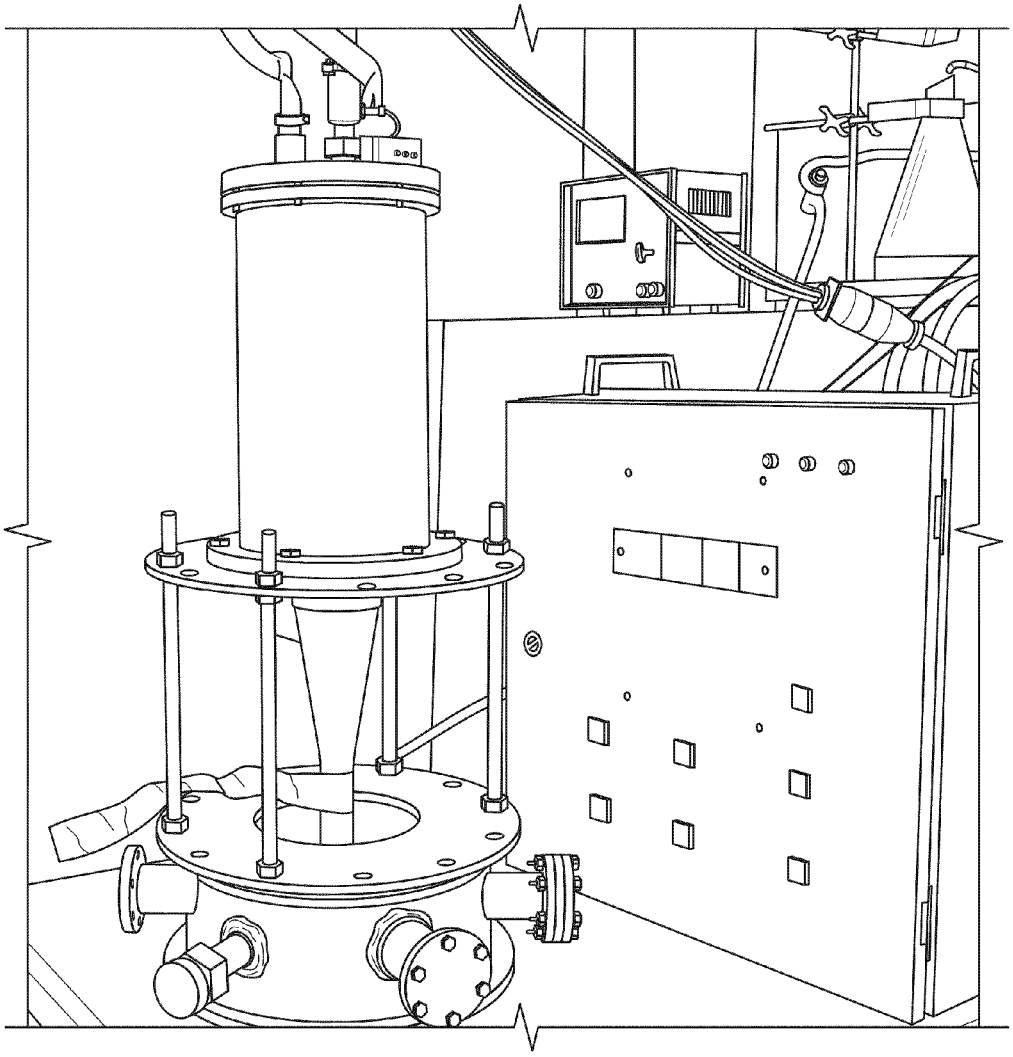
FIG. 9 is a drawing showing an external view of an assembly for the initiation of VSPD within liquids, using electro acoustic (magneto-strictive) transducers as a source of EV.

FIG. 9 illustrates an experimental setup of the design described above. On the front left, a reaction chamber can be seen, in which a magnetostrictive transducer with a waveguide system is placed. On the front right, an ultrasonic generator can be seen. In the background to the left, a high-voltage pulses transformer can be seen, and to the right, there is a gas collector.

Figure 10:
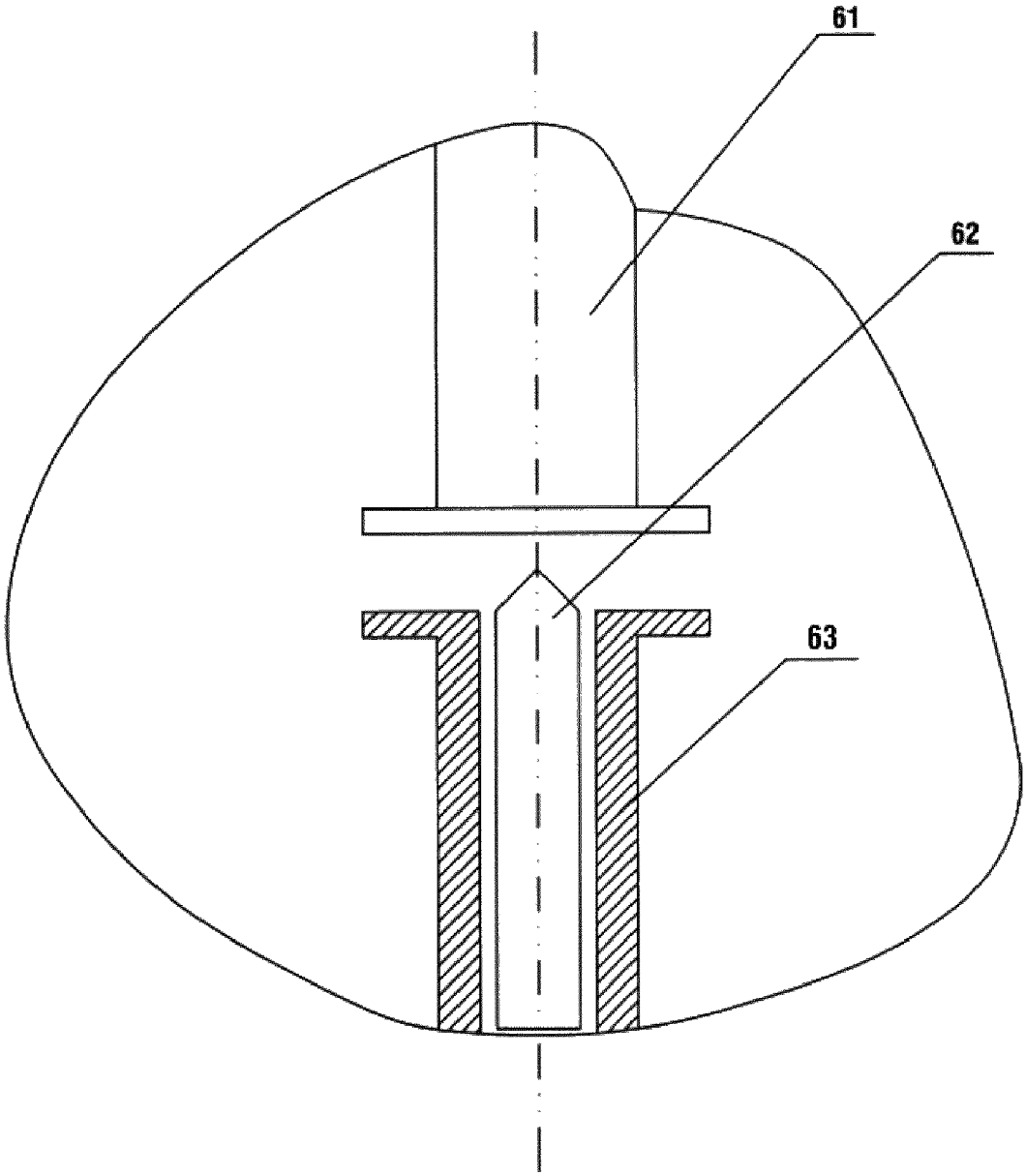
FIG. 10 shows a device for the implementation of VSPD initiation and glow discharge, using one pair of electrodes.

In several cases, the arrangement includes a device that allows the initiation of VSPD and glow using one pair of electrodes. In this case, as illustrated in FIG. 10, the electrode—waveguide (61) remains unchanged, and in the central part of the second electrode, a hole was drilled for providing steady-state conditions of discharge glow, into which a movable rod electrode (62) for initiation of the discharge is located. In the initiation mode, the movable rod is moved to a position that decreases the interelectrode distance, and in the glow mode, it is returned to its original position in which its needle-shaped end is located in the electrode plane (63).

The proposed method of VSPD initiation is implemented in the following manner.

Referring back to FIGS. 7 and 8, after the reaction chamber (43) is filled with a liquid-phase working medium (50), such as distilled water, the ultrasonic generator (item 3, FIG. 6) is switched on, and it is tuned to a resonance frequency. Electric oscillations from the generator are transmitted to the magnetostrictive transducer (41), which transforms them into mechanical vibrations of the same frequency, which are sent through the waveguide (26), this being a radiating section of the vibration system. The mechanical waves are transmitted to the working medium (50). Then, on increasing and regulating the generator power, a stable region of cavitation noise of the required level is created within the working medium; this power being, for example, 1.2 times higher than the threshold value for cavitation within the working medium. As an example, in distilled water this cavitation is obtained by the excitation of EV with a displacement amplitude of the free face of the waveguide of 5 to 7 μm. A higher level of cavitation noise is achieved with larger values of the amplitude of vibrations, whose maximum can be limited to 60 μm.

Thereafter, the power supply for initiation of the discharge is switched on (item 1, FIG. 6). This component shapes the waveform of the voltage ignition pulse, and determines its duration. The pulse is transmitted through the copper rod electrodes (44) to the working medium (50).

Immediately after the application of the ignition pulse causing the electric breakdown of the working medium (50), the power supply (item 2, FIG. 6) feeds enough voltage to the electrodes (46, 47) to initiate the VSPD within the working medium (50), and to sustain its stable glow. This is a rational way to exert a directional influence on the working medium (50) substance. The maintenance of the discharge is done through discharge electrodes (46, 47), the upper one (47) being an element (waveguide) of a vibration system.

A series of tests were performed with the above described assembly. An ultrasonic generator with a magnetostrictive transducer provided the regulation of output acoustic power from 0.5 to 2.0 kW in the frequency range of 22±1 kHz. The parameters of acoustic equipment allowed for the control of the intensity of radiation going into the working volume (50) of liquid, up to 10 W/cm$^2$, and the variation of the cavitation regime within a wide range. The characteristics of cavitation (amplitude and spectrum of acoustic noises) were controlled using a cavitation meter (item 10, FIG. 6).

The sonoplasma discharge was initiated using a capacitor of 50-100 μF capacitance, which was charged to a voltage of U=500-800 V. The duration of the arc initiation pulse was 0.1 μs.

The discharge current was measured using resistive shunts, and voltage was measured using a resistive divider connected to the discharge electrodes (46, 47). An oscillograph registered current and voltage oscillograms.

The procedure for implementation of VSPD using a device that allows the execution of VSPD initiation and glow with one pair of electrodes (FIG. 10) is similar to one described above. Initiation of discharge is performed when the rod electrode (62) is moved to its upper position (3-5 mm from the upper electrode). Under conditions of stable discharge glow, the electrode (62) is returned to the original position, where the tip of its needle-shaped end lies in the lower electrode plane (63).

Figure 11A:
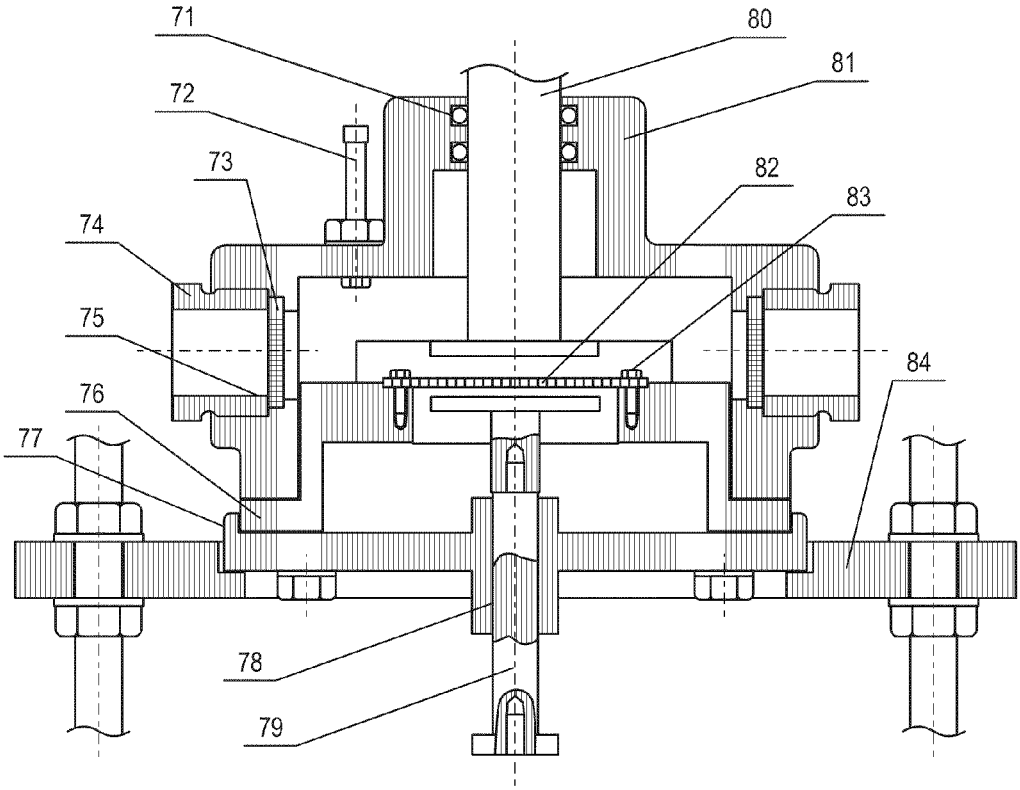
FIGS. 11*a* and 11*b*, show a reactor for the initiation of VSPD within electrolytes, using electro acoustic transducers as a source of EV.
Figure 11B:
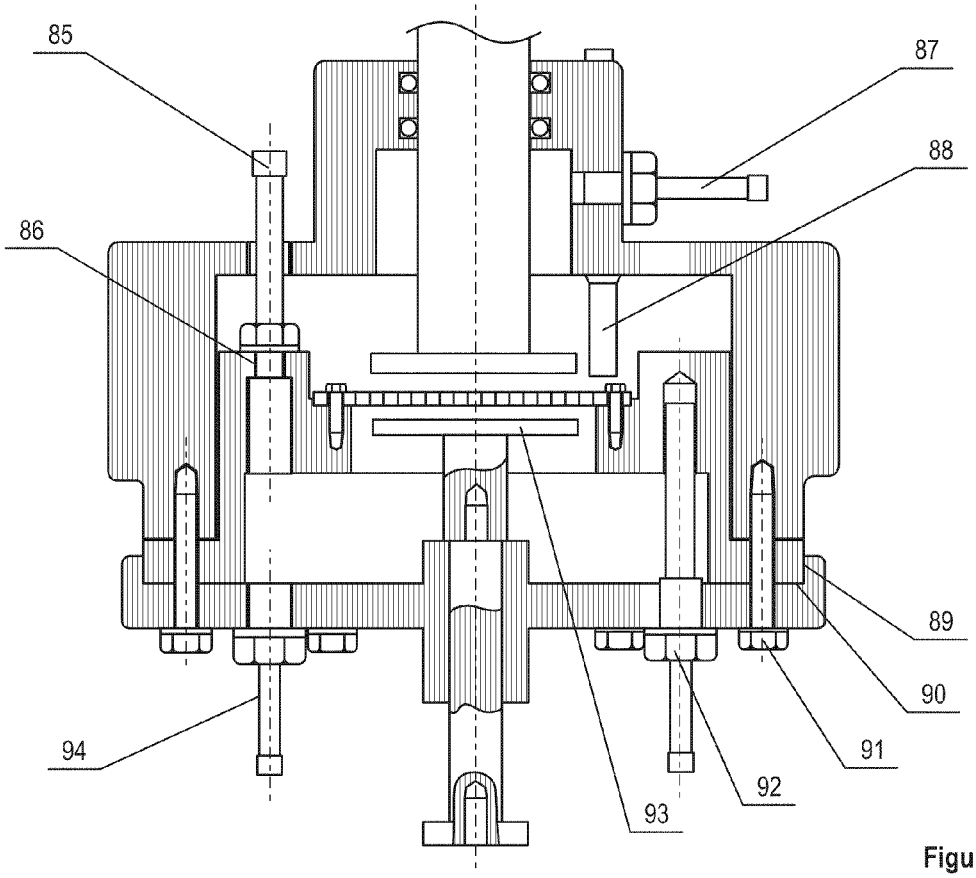

A scheme of a reactor for excitation of VSPD within electrolytes, using electroacoustic transducers as a source of EV, is presented in FIGS. 11*a* and 11*b*.

One of the design features of such a setup for initiation of VSPD within electrolytes is the presence of a membrane that divides the reactor into two spaces. At the center of the membrane there is a small-diameter hole allowing the transfer of the liquid phase between the lower and upper spaces.

Similarly to the just described reactor with initiation of a discharge within non conducting liquids for electrolytes, the reactor is mounted on the support shown in FIG. 7—the reactor tray (77) is placed onto a plate (84). The tray is fastened to the reactor housing (76), forming the lower section that is filled with a liquid phase. The supply of the liquid phase is through a first nipple (94), and its withdrawal is through a second nipple (92). A gas phase is withdrawn through a third nipple (85). The position of electrode (93) and therefore the interelectrode distance is adjusted using a screw device (79).

A cover (81) is fastened to the reactor housing from the top, forming the upper section that is filled with a liquid phase. A radiator (80), which is simultaneously the upper electrode (the supply of current to this electrode is not shown in the FIGS. 11*a* and 11*b*), is introduced into this space from the top. Two observation windows, which preferably comprise a tubule (74) pressing glass (73) to the cover, were provided on the cover. The upper section was fitted with a nipple for liquid phase supply (88), a nipple for withdrawal (72), and a nipple for gas phase withdrawal (87).

The reactor housing is connected to a tray and cover with the help of bolts (91). The lower section is separated from the upper with membrane (82), which is fastened to the housing with bolts (83).

All connections, elements, and inlets in this reactor design, the different devices inside the reactor, and outlets from it, are tight and have sealing gaskets, including without limitation the connections of the reactor housing to cover (89) and tray (90), inlet of radiator (71), observation window (75), locator of electrode (78), nipples for gas withdrawal from the lower (86) and upper sections, and nipples for liquid phase supply and withdrawal to and from the lower and upper sections (some gaskets are not shown in the figure).

The proposed method for initiation of VSPD within electrolytes, in the assembly shown in FIGS. 11*a* and 11*b*, is implemented in the same way as for the one described above: first, elastic vibrations having enough intensity sufficient to generate cavitation are excited in the reactor, then the initiation of discharge and the transition to the regime of its stable glow are performed.

For example, the sonoplasma discharge can be initiated using a capacitor with capacity 50-100 μF capacitance, charged to voltages of U=500-800 V. An arc initiation pulse with a duration of 0.1 μs has been used successfully.

The electrical, optical and acoustic parameters of the processes using sonoplasma discharge were recorded using the same equipment as the one described for the case of initiating VSPD within non-conducting liquids.

Figure 12:
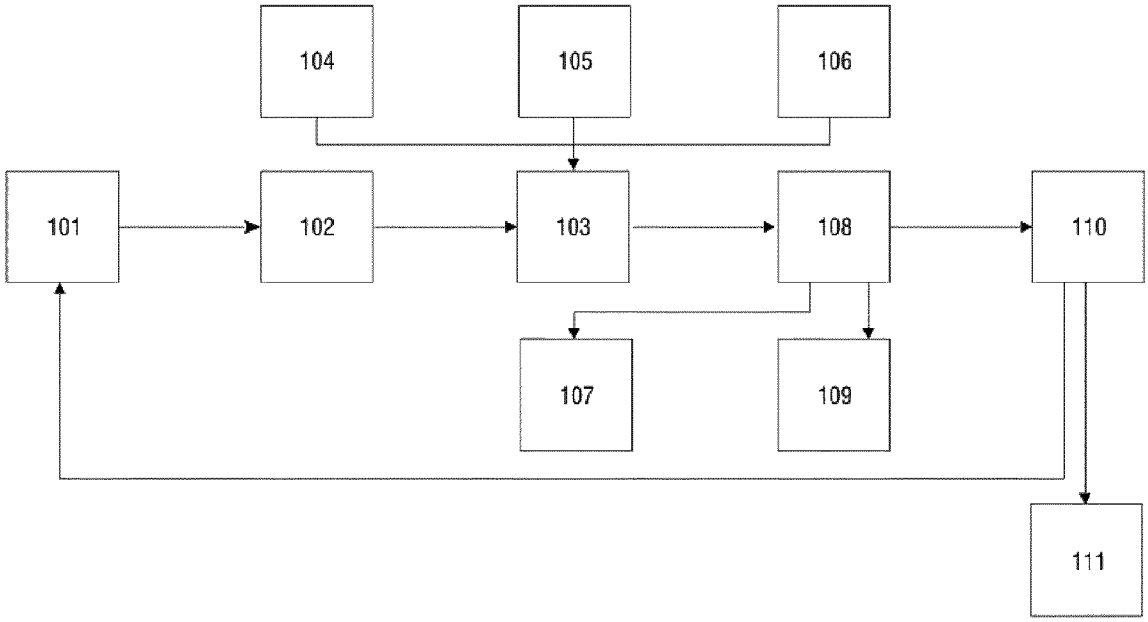
FIG. 12 is a block diagram of a flow-type reactor for the initiation of VSPD within a liquid-phase working medium, to carry out chemical reactions with the formation of gas- and solid phases.

FIG. 12 shows a scheme of a flow-type installation for VSPD excitation within a liquid-phase working medium when chemical reactions with the formation of gas and solid phases are carried in it.

A series of tests were done, with the liquid phase being supplied from the tank (101) to the reactor (103) using the pump (102). The systems for initiating the discharge (104) and sustaining the glow discharge (105), and for supplying elastic vibrations (106), implement the VSPD in the reactor. The products formed are sent to the separating chamber (108), from which the gaseous products pass to the accumulator (107), and solid-phase and liquid-phase products are sent to the accumulators (109) and (110), respectively. The non-reacted liquid phase is returned to the tank (101) while the desired end product is sent to tank (111).

Figure 13A:
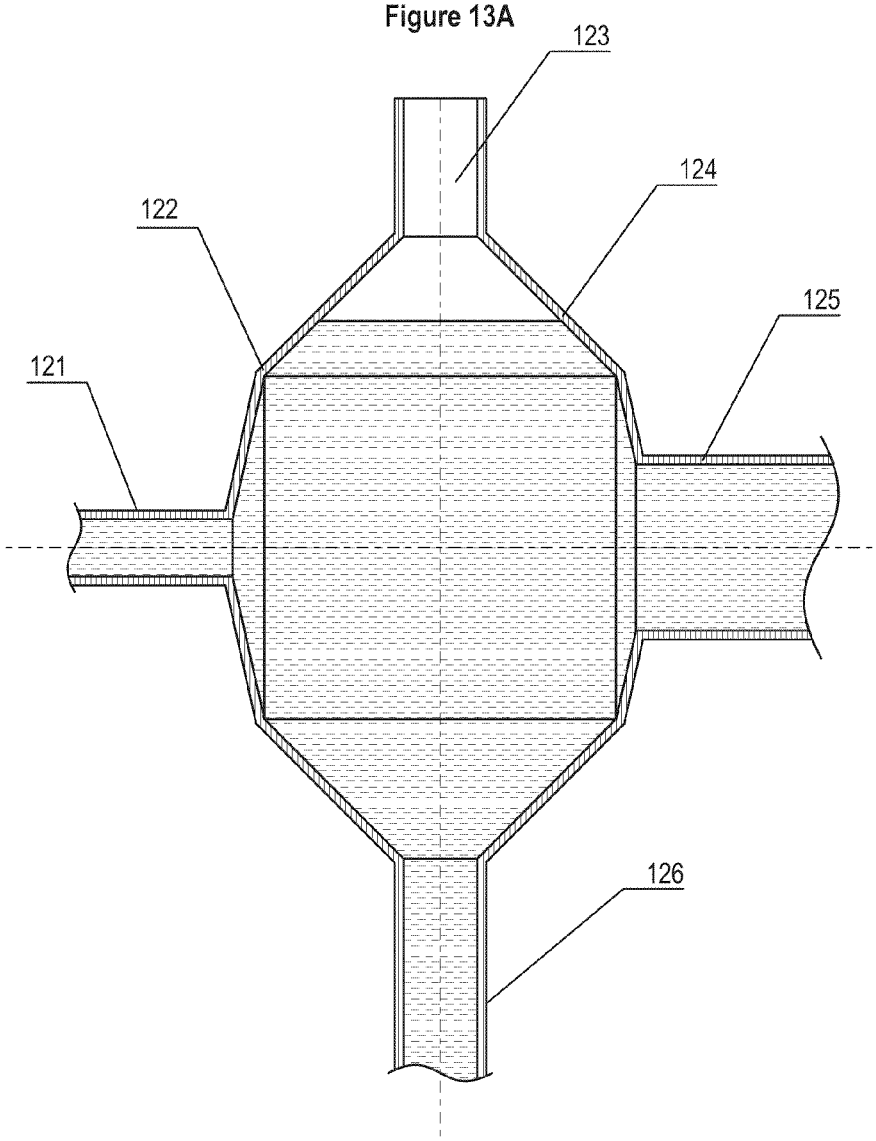
FIGS. 13*a* and 13*b* show a flow-type reactor for the initiation of VSPD within a liquid-phase working medium, to carry out chemical reactions with the formation of gas- and solid phases.
Figure 13B:
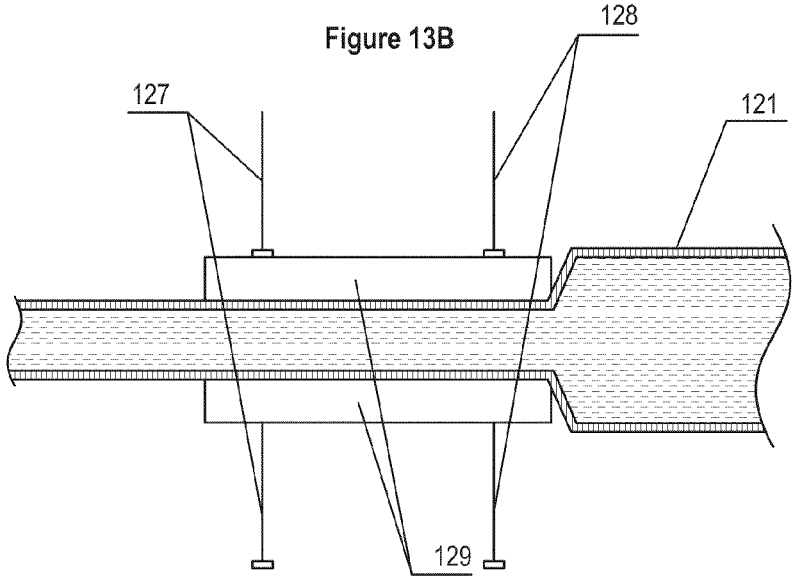

FIG. 13 shows a scheme of a flow-type reactor for excitation of VSPD within a liquid-phase working medium when chemical reactions with the formation of gases and solids phases are implemented within, where FIG. 13A is a side view and FIG. 13B is a top view.

The reactor (122) has the form of a parallelepiped, whose two opposite walls serve, simultaneously, as electrodes and as ultrasonic vibration sources (129). In this case, electroacoustic transducers of piezoelectric type, which are connected to a radiator diaphragm, were used in vibration systems. Power-supply wires are connected to the electrodes' vibration systems, from the ultrasonic generator (128) and discharge power supply (127).

Nipples for supply (121) and withdrawal (125) of liquid phase (124), as well as for gas phase withdrawal (123) and drainage of liquid phase with a solid-phase precipitate (126), are connected to the reactor.

The procedure for VSPD implementation in this case is similar to the ones above described. On reaching the regime of VSPD stable glow, and as chemical reactions occur and the original liquid phase is consumed, further supply of the liquid phase to the reactor is done through nipple (121). The gas phase formed is withdrawn from the reactor through nipple (123), and a mixture of liquid-phase reaction products and the original liquid phase is withdrawn through nipple (125). Drainage of liquid phase with a solid-phase precipitate formed in the reaction was periodically performed through nipple (126).

Experiments were conducted with this setup, given a 1000 ml volume of the reaction chamber. An ultrasonic generator with piezoelectric transducers provided the control of output acoustic power from 100 to 400 W in the frequency range 23±1 kHz. The parameters of the acoustic equipment allowed the control of radiation intensity into the working volume of liquid up to 2 W/cm$^2$ at each radiator, and to vary the cavitation regime within a certain range. The characteristics of cavitation (amplitude and spectrum of acoustic noises) were controlled by means of a cavitation meter (item 10, FIG. 6).

Sonoplasma discharge was initiated using a battery of capacitors with 100 μF capacitance, charged to voltages U=500-1000 V. The duration of the arc initiation pulse was 0.1 μs.

Figure 14:
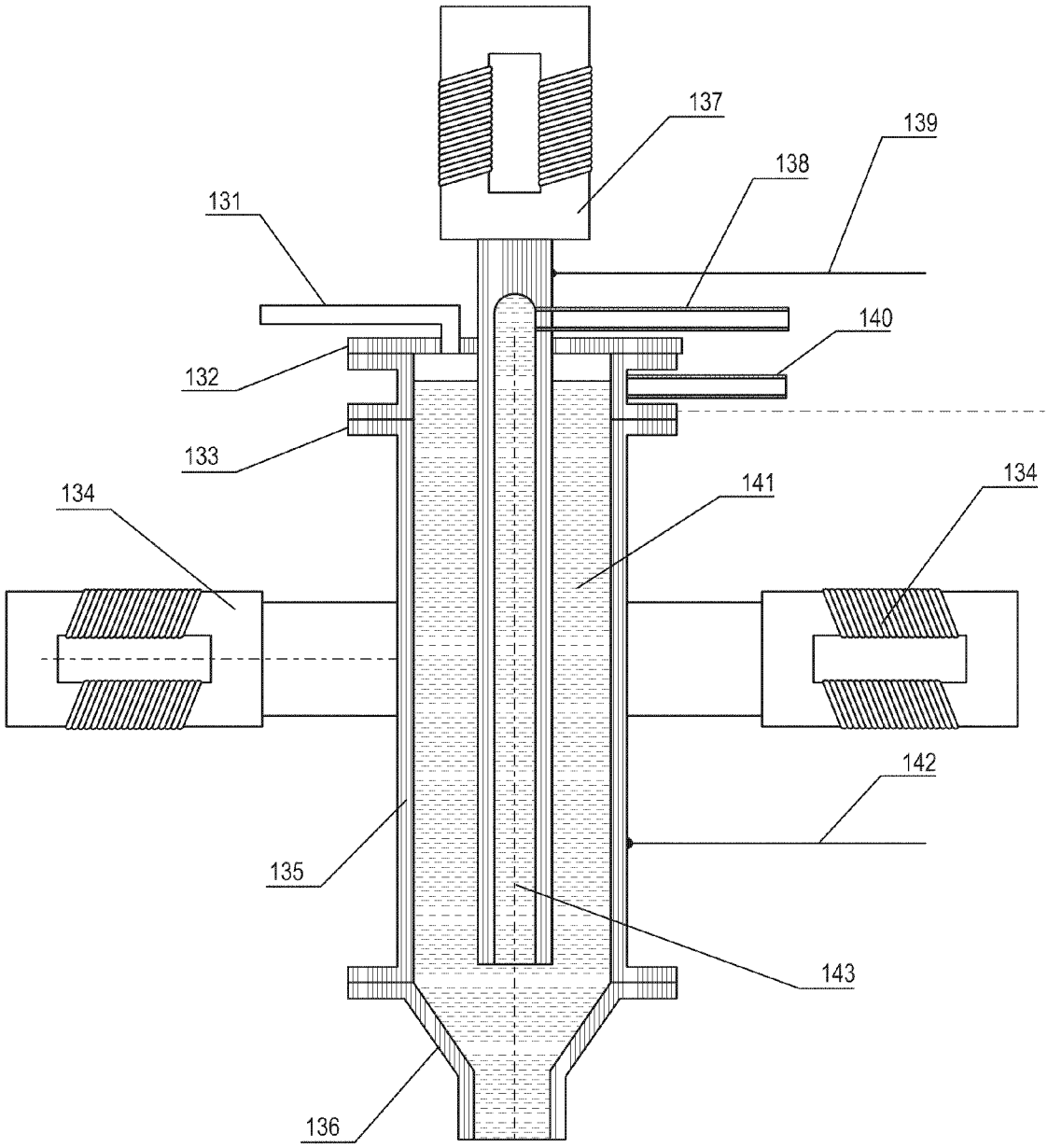
FIG. 14 shows a second preferred embodiment of a flow-type reactor to initiate VSPD within liquids, with EV supply through the electrode and reactor walls, using electro acoustic transducers as sources of EV.

FIG. 14 shows a scheme of a flow-type reactor for excitation of VSPD within liquids, when EV is introduced through the electrode and walls of the reactor.

The reaction chamber (135) is a hollow cylinder, whose dimensions (height, outside diameter, wall thickness) were calculated with the possibility of EV excitation in resonance mode in mind. The sizes of the reactor are calculated using special computer programs, such as FEA, Atila, and Mathematics. The chamber has 2 electroacoustic transducers (134) of the magnetostrictive type attached to it, which are positioned along a line passing through an axis in a perpendicular plane to the axis of the hollow cylinder of the reaction chamber 35 and at a height equal to half the height of the reaction chamber. The internal walls of the chamber serve as one of the electrodes for discharge initiation and glow. Power supply wire (142) is connected to the chamber. Waveguide (143) serves as the second electrode, with a developed surface where longitudinal vibrations are transformed into radial vibrations. The waveguide is made in the form of a tube. The supply of liquid phase (141) to the reactor is done through the internal channel of this waveguide, to which supply nipple (138) is connected. The waveguide is connected to a magnetostrictive transducer (137) and current-supply wire (139). Spacer plate (133) with nipple (140) for liquid phase withdrawal from the reactor is mounted onto the reactor. The waveguide passes through the reactor cover (132), and is introduced into the reaction chamber. A nipple for gas withdrawal (131) is installed on the reactor cover. A device for draining the precipitate (136) is connected to the lower section of the reactor.

In this case, the procedure for VSPD implementation is similar to the procedures described above.

After filling the working chamber space (135) with a liquid-phase working medium (141), ultrasonic generators (position 3, FIG. 6) are switched on. In this case, two ultrasonic generators are used in the assembly: one for power supply of the magnetostrictive transducer (137) for supplying EV to the waveguide-electrode (143); the other of the two transducers (134) supplies EV to the reactor housing. After reaching the adequate regime for the implementation of stable cavitation within the liquid phase, the initiation of discharge and transition to the regime of its stable glow are performed.

With this setup, a second series of experiments was performed. Ultrasonic generators with magnetostrictive transducers provided the regulation of output acoustic power from 1.5 to 9.0 kW in the frequency range 22±1 kHz. The parameters of acoustic equipment allowed the regulation of the intensity of radiation into the working volume of liquid to up to 5 W/cm$^2$.

Sonoplasma discharge was initiated using a capacitor with 50-100 μF capacitance, charged to voltages U=500-800 V. The duration of the arc initiation pulse was 0.1 μs.

The supply of an original liquid phase to the reactor and the withdrawal of gaseous, liquid- and solid-phase products were performed in the same way as when working with the assembly represented in FIG. 13.

Figure 15:
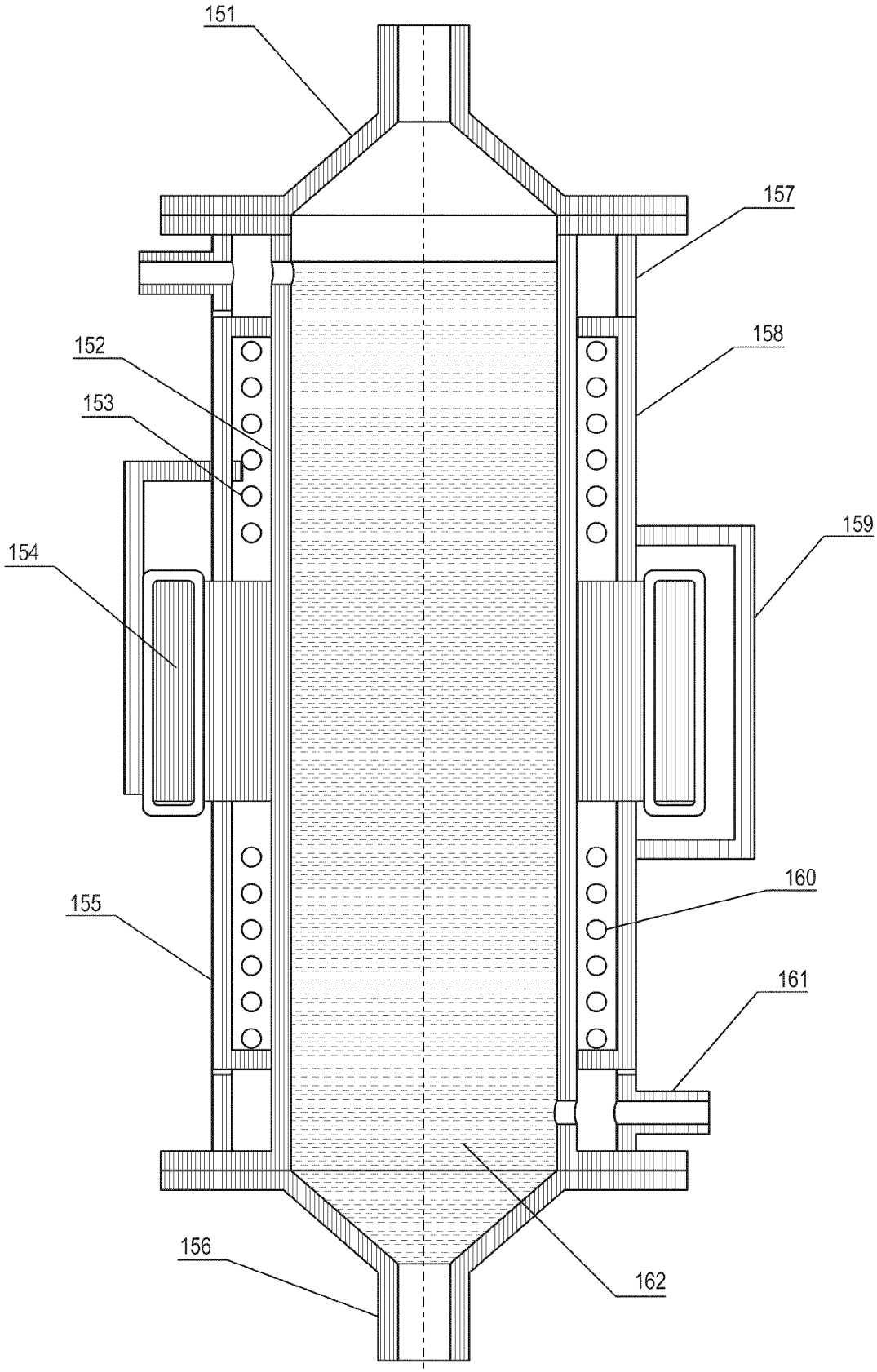
FIG. 15 is a sketch of a reactor using an induction method for the initiation of plasma discharge, and an electro acoustic transducer for the creation of EV.

FIG. 15 shows a scheme of the reactor when using a high-frequency generator (megahertz range) as EFS, in an induction method for the initiation of plasma discharge, and an electroacoustic transducer for the excitation of EV.

Two induction coils—an upper one (153), and a lower one (160)—are installed in the housing of the reactor (152). The coils are placed into casings (158 and 155, respectively) that have the same dimensions and electro technical characteristics. They are positioned one above the other at a distance equal to their height. A ring magnetostrictive transducer (154) placed into a water-cooled tank (159) is located between them.

The liquid phase (162) enters the reactor through a first nipple (161) and discharges from it through a second nipple (157). A nipple for gas phase withdrawal is installed on the reactor cover (151). The reactor is provided with a device for draining the precipitate.

In this case, the procedure for implementing VSPD is similar to the ones described above.

After reaching the regime for the implementation of a stable cavitation within the liquid phase, the excitation of VSPD is performed: High frequency electric oscillations and voltages adequate for discharge initiation and stable glow are applied to induction coils (3 and 10 of FIG. 6).

A third series of experiments was performed with this assembly. An ultrasonic generator with a ring magnetostrictive transducer provided the regulation of output acoustic power from 1.0 to 4.0 kW in the frequency range of 20±1 kHz. The parameters of acoustic equipment allowed the regulation of the intensity of radiation, to up to 20 W/cm$^2$ into the working volume of liquid.

Sonoplasma discharge was initiated using a high frequency generator using 600 W of power, at a frequency of 15 MHz. The voltage for a stable glow discharge was 100-800 V.

Figure 16:
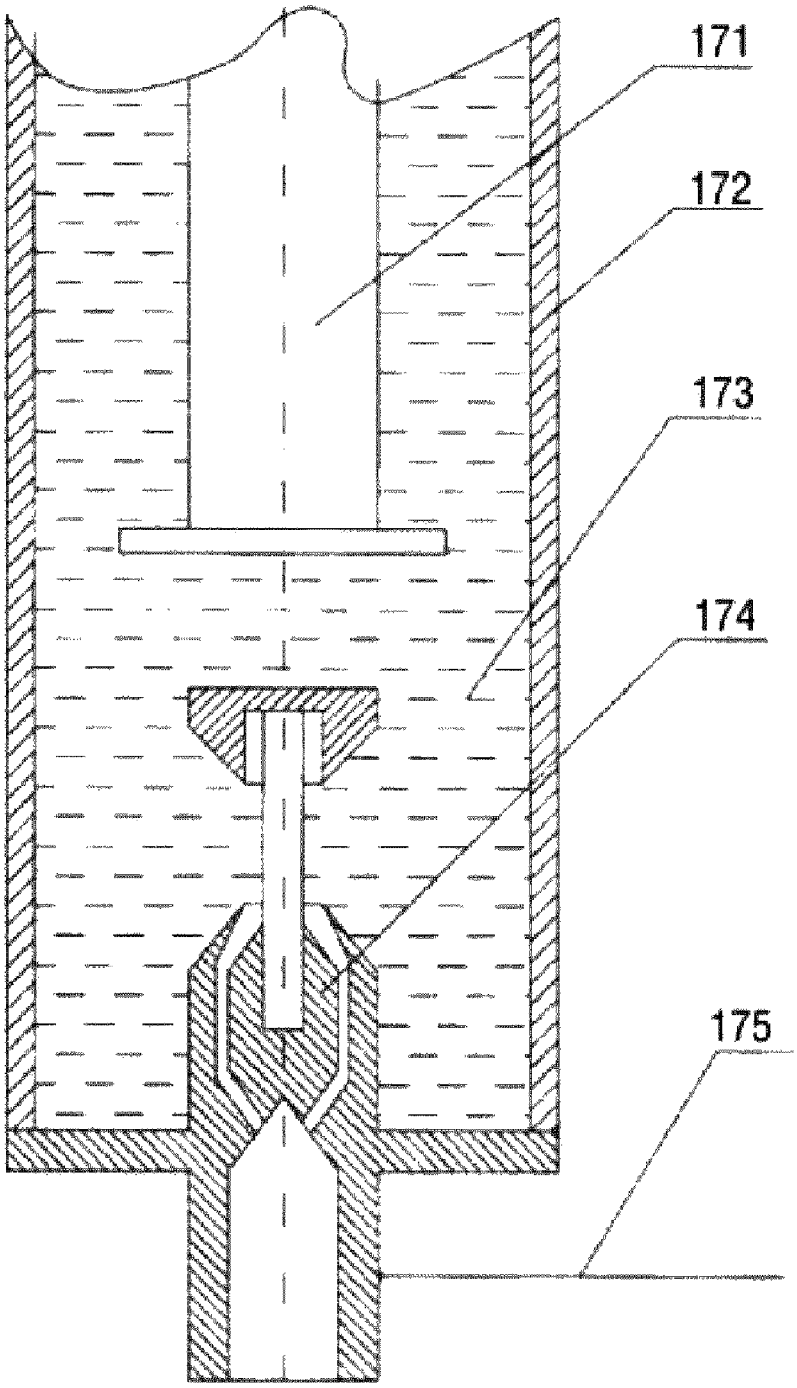
FIG. 16 is a sketch of a third embodiment of a reactor for VSPD initiation within liquids, with EV excitation by means of a mechanoacoustic (hydrodynamic) radiator.

The scheme of a reactor for excitation of VSPD by creating an acoustic field within the liquid, and using a mechanoacoustic (hydro- or gas-dynamic) radiator is presented in FIG. 16.

The mechanoacoustic radiator (174) is connected to reactor (172). When a hydrodynamic radiator is used, liquid phase (173) is supplied to the reactor through the radiator. EV, whose frequency is adjusted by changing the dimensions of the radiator, is excited within the liquid phase. When a gas-dynamic radiator is used, a gas stream is supplied to the liquid medium, entering through the radiator. The gas stream flow is broken into small bubbles. The mechanoacoustic radiator can also act as an electrode. In this case, a power-supply wire (175) is connected to it. A second electrode (171), can be used thereby connecting the waveguide to an electroacoustic transducer.

The method of VSPD initiation is implemented in the following manner:

To fill the reactor (172), whose volume is 150 mL, with the liquid phase (173), the flow mode for its operation is adjusted using a hydrodynamic radiator (174). In this case, the liquid phase is pumped to the reactor (item 6, FIG. 6). After reaching the regime for the implementation of a stable cavitation within the liquid phase, the excitation of VSPD was performed. The initiation and maintenance of the discharge is done through the discharge electrodes (171) and (174), the upper one being an element (waveguide) of a vibration system, and the lower one being a mechanoacoustic radiator.

When a gas-dynamic radiator is used, gas stream enters through and goes to the liquid medium. The EV is generated within the gas stream, whose flow is broken into bubbles.

An ultrasonic generator with a magnetostrictive transducer allows the regulation of the output of acoustic power, from 0.5 to 4.0 kW, in the frequency range 22±1 kHz. The parameters of acoustic equipment allow the control of the intensity of radiation into the working volume of liquid, to up to 30 W/cm$^2$.

In a fourth series of experiments, a hydrodynamic radiator was used having the following main technical characteristics:

output: up to 0.5 m$^3$/h fundamental tone frequency: 1.5 kHz operating pressure: 6.0 atm intensity of generated vibrations: 5.0 W/m$^2$ The gas-dynamic radiator had the following characteristics:

air flow rate from 0.02 to 3.3 m$^3$/min operating frequencies: 10.0-18.0 kHz power: 0.7 kW;

vibration power: 2.0 W/cm$^2$

The sonoplasma discharge was initiated using a capacitance of 50-100 μF, charged to voltages U=500-800 V. The duration of the arc initiation pulse was 0.1 μs.

Figure 17:
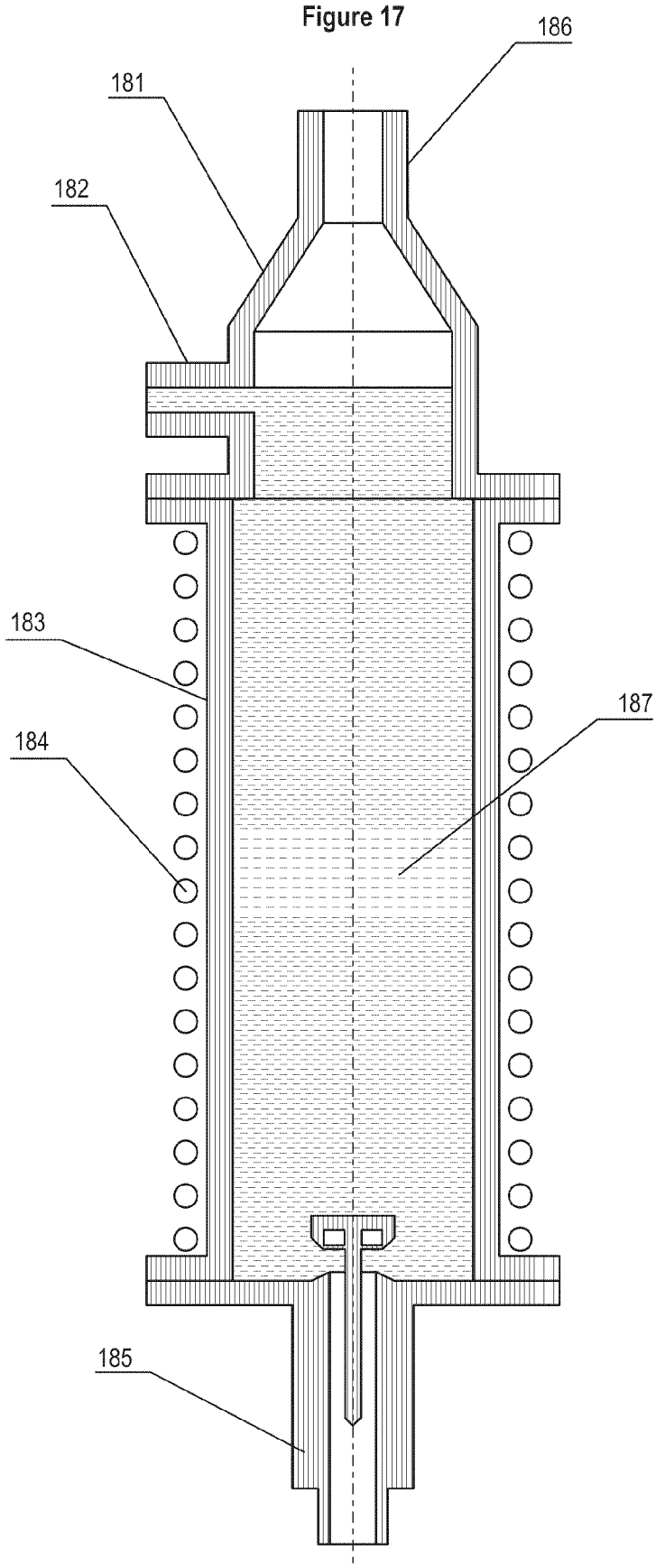
FIG. 17 shows a flow-type reactor using an induction method to initiate a plasma discharge, and a mechanoacoustic radiator to create EV.

FIG. 17 shows a scheme of a flow-type reactor when using an induction method for the initiation of plasma discharge, and a mechanoacoustic radiator for the excitation of EV.

An induction coil (184) for initiation of the discharge is located around the reactor housing (183). A mechanoacoustic radiator (185) of the hydrodynamic type, through which the liquid phase (187) is supplied to the reactor, is connected to the reactor housing.

The method for initiation of VSPD is as follows:

In order to fill the reactor (183) with the liquid phase (187), the flow for its operation is passed through the hydrodynamic radiator (185). After reaching the regime for the implementation of a stable cavitation within the liquid phase, the excitation of VSPD is done; to this end, high frequency electric oscillations are applied to the induction coil (184) at voltages adequate for discharge initiation and stable glow.

A fifth series of experiments was performed using hydrocarbon compounds in the sonoplasma apparatus. The hydrodynamic radiator described above was used in the experiments.

Sonoplasma discharge was initiated using a HF generator of 600 W power, operating at a frequency of 15 MHz. The voltage of the stable glow discharge was 100-800 V.

Figure 18:
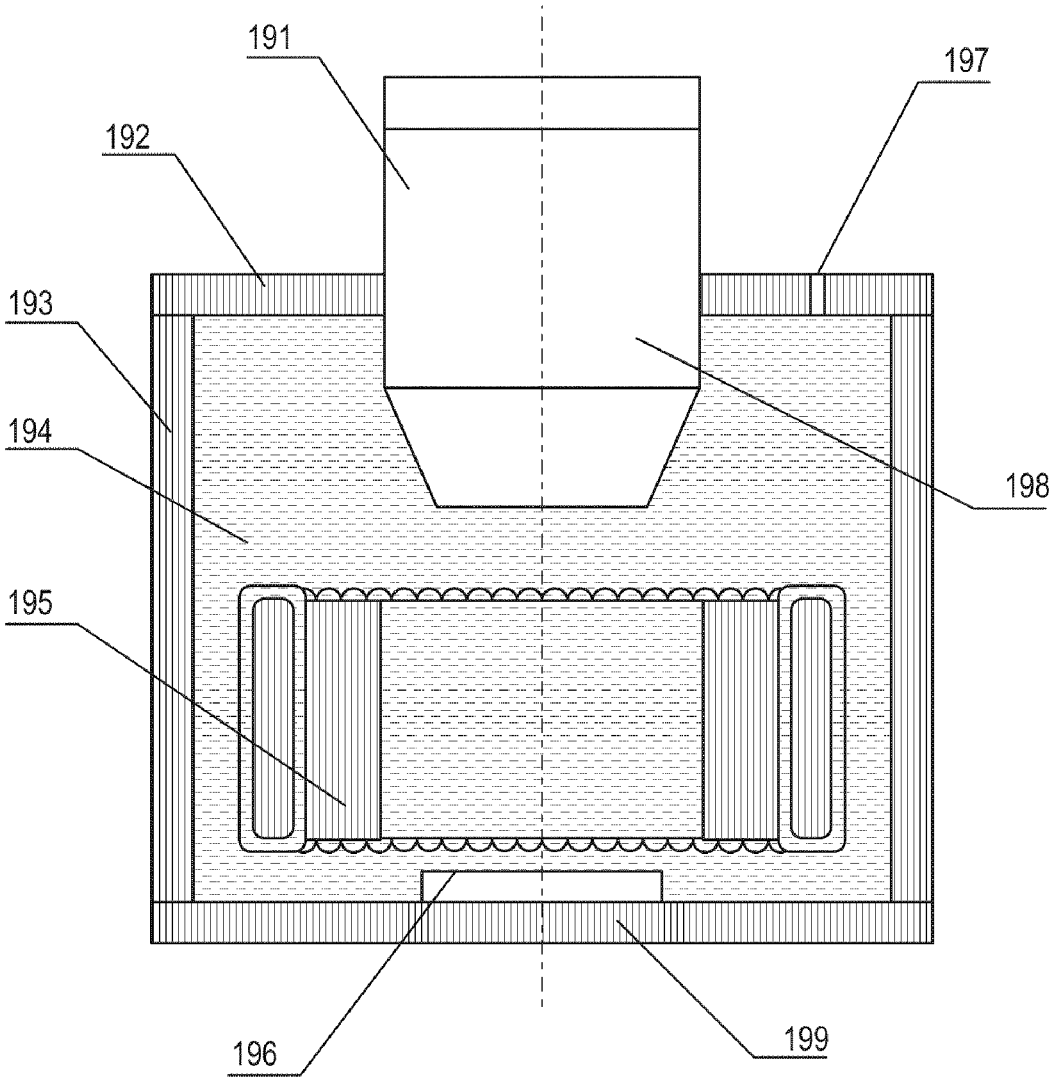
FIG. 18 shows an assembly for surface coating with VSPD initiation within liquids, using a UHF generator (gigahertz range) as a source of an electric field.

The scheme of an installation for surface coating, initiating VSPD within liquids and using an electromagnetic generator as a source of electric field, is presented in FIG. 18.

To initiate an electrical discharge within a liquid (194), a radiator (198) with an electromagnetic generator (191) is introduced through the cover (192) into reactor (193). A ring electroacoustic transducer (195) of the magnetostrictive type is installed into the reactor in such a way that the created cavitation field is located near the radiator of the electromagnetic generator. The electroacoustic transducer is connected to the ultrasonic generator via cables (197).

A support (196), mounted on the reactor tray (199), lies near the electroacoustic transducer and the electromagnetic radiator.

The proposed method for VSPD initiation in this case is implemented in the following way.

After filling the working chamber space (193) with a liquid-phase working medium (194), for example, hydrocarbons (dodecane) or alcohols (methanol), an ultrasonic generator (item 3 in FIG. 6) is switched on, and tuned to the resonance frequency. Electric oscillations from the generator are transmitted to the ring magnetostrictive transducer (195) that radiates them into the liquid-phase working medium (194). By selecting the power of vibrations within the working medium, a stable cavitation region is created.

After setting the regime of stable cavitation in the liquid phase, the excitation of VSPD is performed: Ultra high frequency (UHF) generator (191) provides electromagnetic oscillations into the liquid phase, which allows the initiation of the discharge, and thereafter a stable glow discharge.

As a result of certain chemical reactions carried with this device, a solid phase was formed within the liquid phase, and the solids settled on the support (196).

A sixth series of experiments was performed. An ultrasonic generator with a ring magnetostrictive transducer provided the regulation of output acoustic power, from 1.0 to 3.0 kW, in the frequency range 20±1 kHz. The parameters of the acoustic equipment allowed implementation of the intensity of radiation into the working volume of liquid to up to 20 W/cm$^2$.

The sonoplasma discharge was initiated using a UHF generator with a power of 1,000 W, operating at a frequency of 2.4 GHz. The voltage of the stable glow discharge was 100-800 V.

The above series of experiments about initiation of VSPD, using the described installations (FIGS. 6-18), were carried out using distilled and deionized water, liquid hydrocarbon compounds (chemically pure dodecane, heptane), alcohols (ethanol and isopropanol), conducting liquids with different pH values (diluted solutions of HCl, NaOH, NaCl). In these experiments, electrical and acoustic parameters, as well as the optical features of VSPD, were studied.

Examples of particular parameters for the proposed method, which do not exclude other variants of their execution according to the patent claims, are given below.

Figure 19:
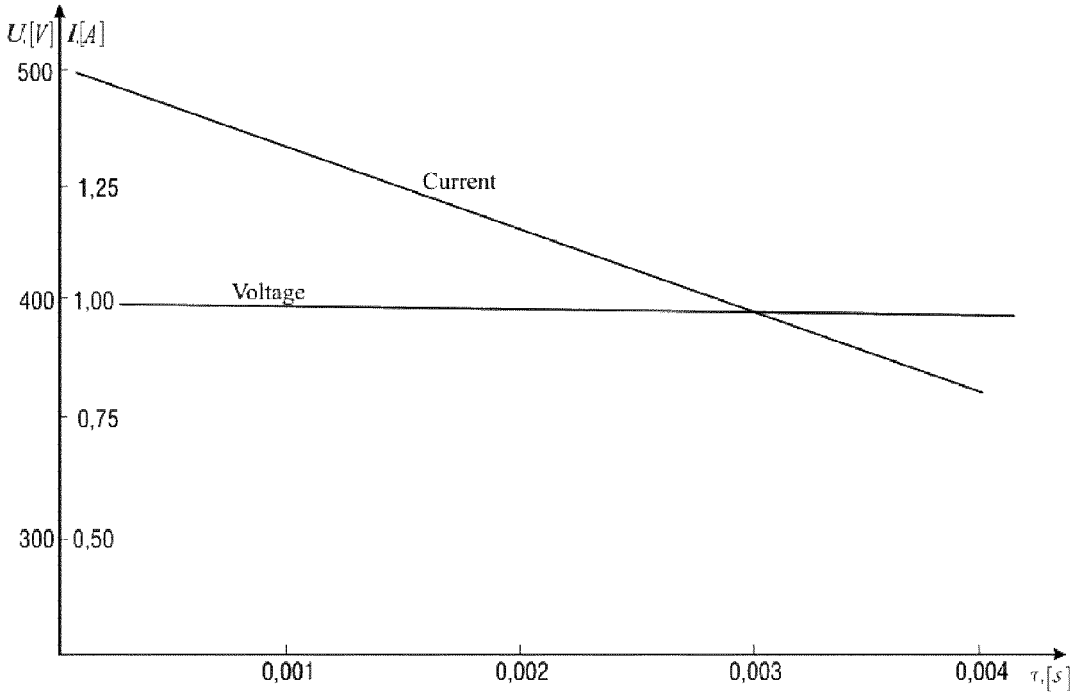
FIG. 19 shows an oscillogram of electrode voltage and discharge current in the absence of cavitation in water.

Typical oscillograms of current and voltage during the capacitor discharge into the discharge gap, using steel electrodes (2, FIG. 3) preferably 50 mm in diameter, with a gap of 5-10 mm between the electrodes, filled with predeionized water, are shown in FIG. 19. These oscillograms show the features of the discharge of the capacitor precharged to a voltage of about 500 V in the absence of cavitation in liquid. The current flow during the capacitor discharge does not exceed 1 A, the glow is absent (plasma discharge is not implemented), the resistance of discharge gap is about 200 ohm, and the density of discharge current is not more than 0.05 A/cm$^2$.

Figure 20:
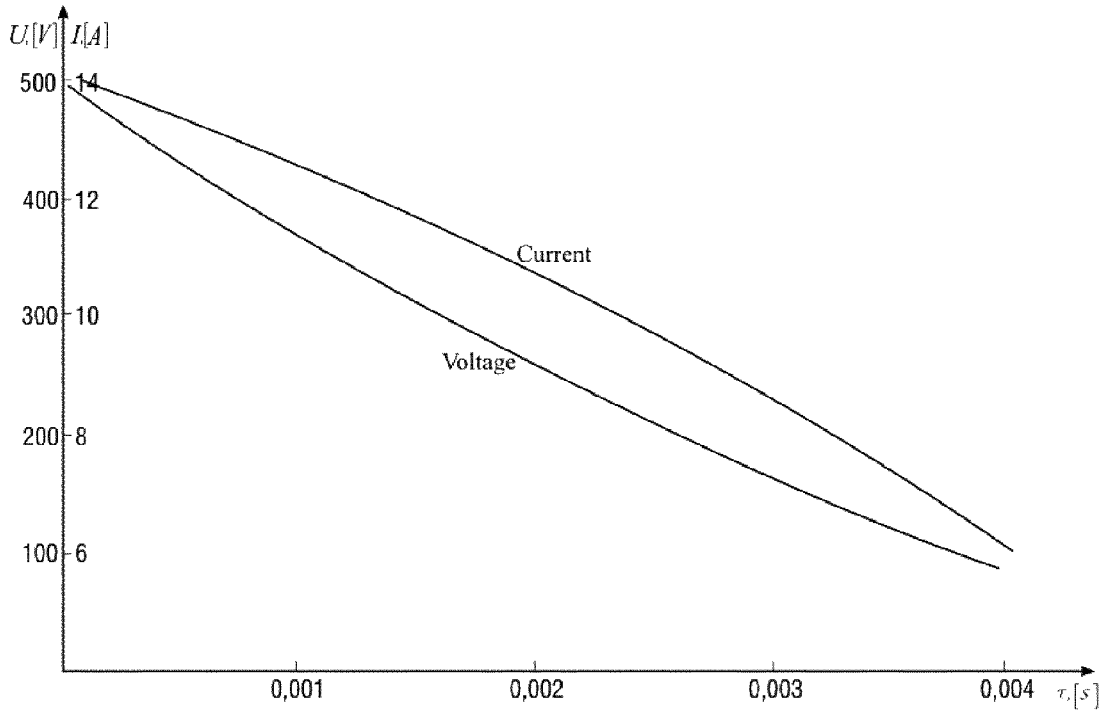
FIG. 20 shows an oscillogram of electrode voltage and discharge current in the presence of cavitation in water.

The character of the capacitor discharge changes fundamentally under conditions adequate for the development of ultrasonic cavitation in liquid (FIG. 20). In this case, the resistance of discharge gap is about 15 ohm at the beginning of discharge and smoothly increases up to 20 ohm just before the breaking of current.

Figure 21:
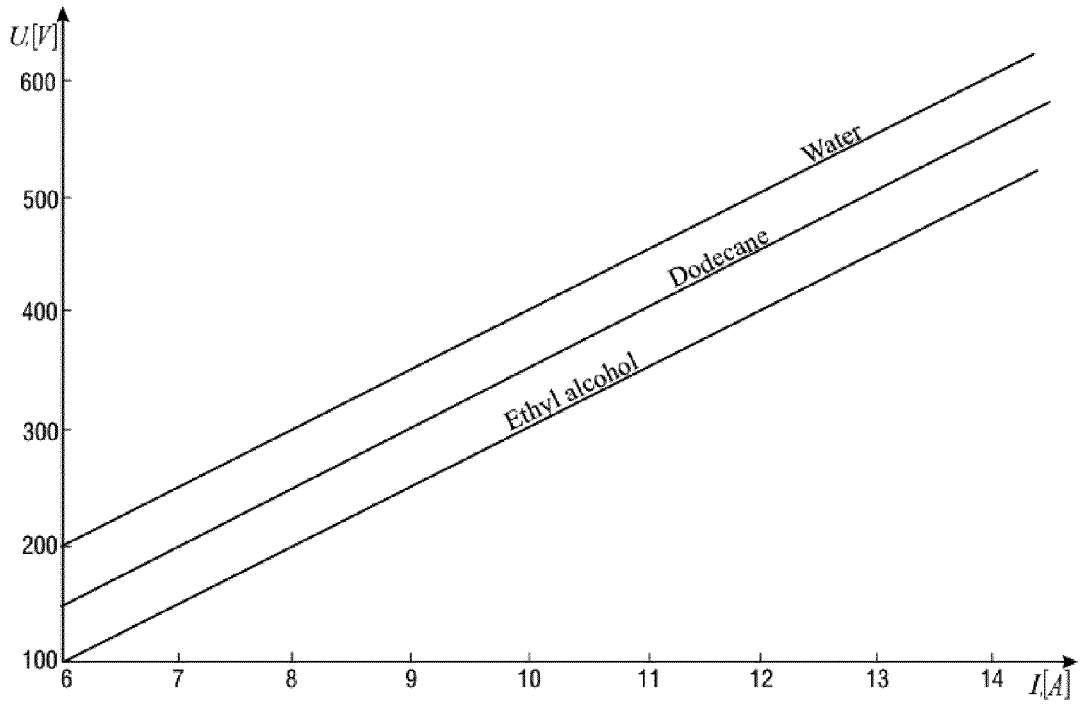
FIG. 21 shows volt-ampere characteristics of VSPD in water, dodecane and ethyl alcohol in the presence of cavitation.

FIG. 21 shows volt-ampere characteristics of discharges within cavitating liquids (water, dodecane, and ethyl alcohol) in a voltage (U)-current (I) graph. These discharges occur during the capacitor discharge. According to these curves, the volt-ampere characteristics within cavitating water rise steadily in the range from 200 to 500 V; the current in cavitating liquids increases from 6 to 14 A. The density of the discharge current is 0.2-0.6 A/cm$^2$. Similar volt-ampere characteristics are also observed in other investigated liquids.

Some electrical characteristics of VSPD in investigated liquids are given in FIG. 32.

With regard to the general properties of the development of cavitation phenomena in investigated liquids, it is shown that they arise at certain values of amplitude of radiator vibrations $\xi_{mth}$ (FIG. 33). The level of cavitation noise $P_n$ increases with a rise in vibration amplitude up to a certain value $P_{n\ max}$ characteristic of the specific liquid and experimental conditions, and then they virtually do not change with a further increase of the amplitude.

Figure 22:
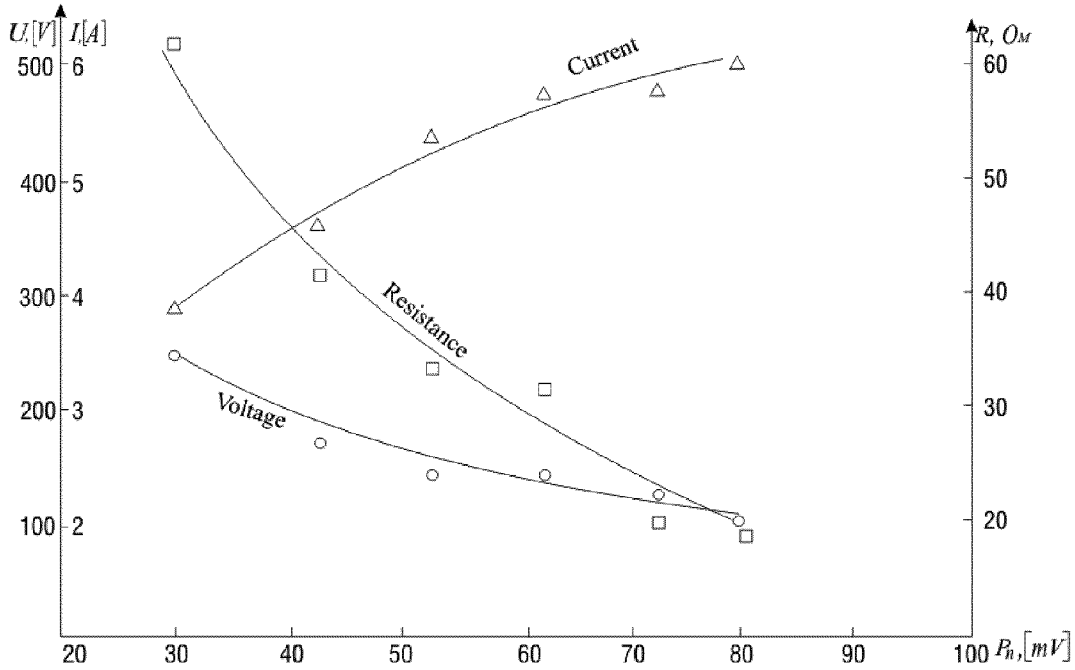
FIG. 22 represents the variation of electric parameters of VSPD as a function of the degree of cavitation (level of cavitation noise).

The analysis of the influence of the degree of cavitation development (level of cavitation noise $P_n$) on the electrical parameters of VSPD, showed that with a rise in $P_n$, the minimum voltage of the stable glow discharge decreases, the current increases, and the resistance decreases (FIG. 22).

FIG. 32 is a table showing the electrical characteristics of VSPD within different liquids. VSPD excitation was performed at the maximum possible cavitation noise level under experimental conditions in a given liquid, $P_{n\ max}$ (see FIG. 33).

Figure 23:
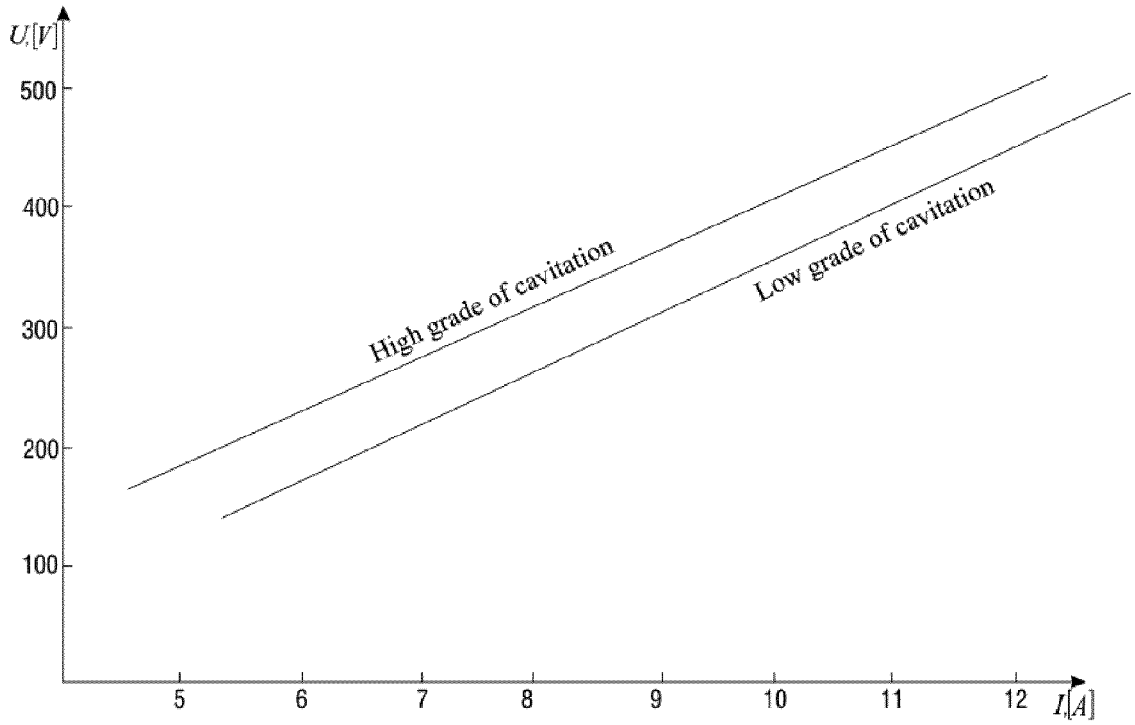
FIG. 23 shows volt-ampere characteristics of VSPD for water as a function of the degree of cavitation development.

Thus, the degree of cavitation development had some influence on volt-ampere characteristics of the discharge in water; however, the rising nature of these characteristics remained, typical of abnormal glow discharges (FIG. 23).

Qualitatively similar features of discharge glow were obtained when implementing VSPD within other non-conducting liquids (dodecane and ethanol).

Figure 24:
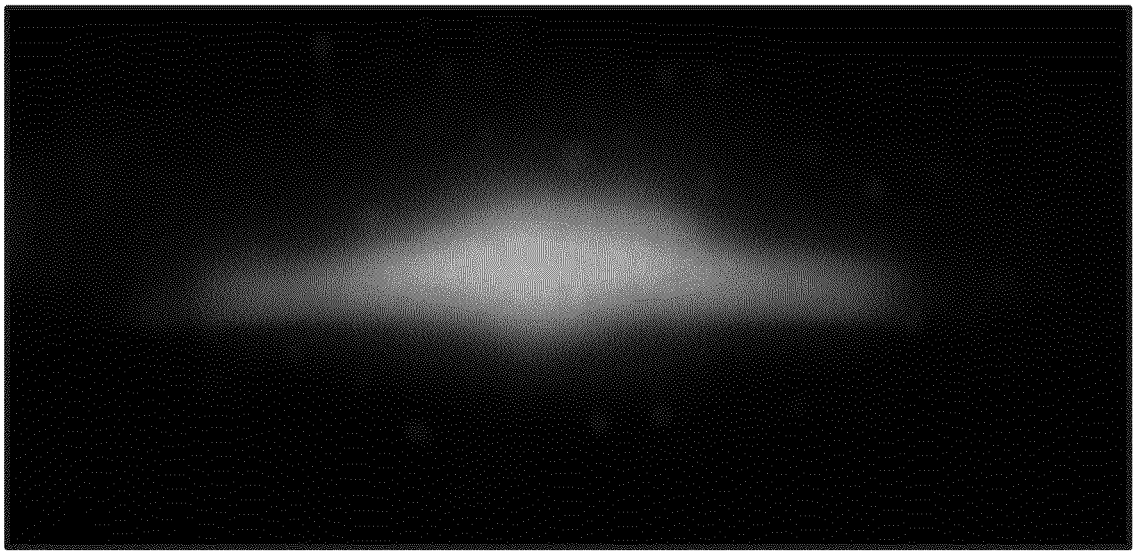
FIG. 24 shows a photograph of VSPD implemented in water.

Under conditions of establishment of VSPD within liquids, quite intense glow arises in the interelectrode space. Thus, when VSPD is initiated in water using a direct-current source with certain electric parameters, such as voltage U=300 V, current I=10 A and level of cavitation noise $P_n$=80 mV, a white-blue glow arises (FIG. 24). At the same electric and acoustic parameters, the plasma initiated within dodecane and ethanol had yellowish and orange hues, respectively.

FIG. 33 is a table showing the specific features of cavitation development in some liquids.

Changes of the electrical and acoustic characteristics of VSPD cause differences in the optical features of the discharge. For example, in experiments with water, it was found that a rise in voltage and an increase of the degree of cavitation during discharge glow caused the shift of the color of the discharge towards the blue-white wavelengths.

Figure 25:
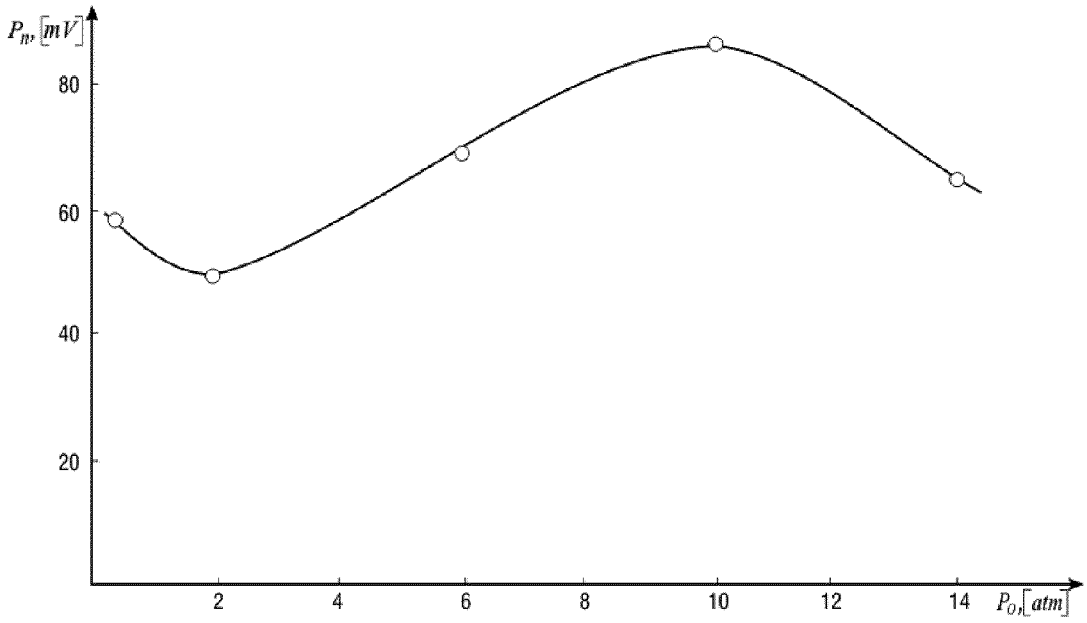
FIG. 25 shows the influence of static pressure in the medium on the level of cavitation noise in water, when the liquid is subjected to EV.

A change in static pressure in a reactor exerts a substantial influence on the character of cavitation development within a liquid phase. For example, a decrease in the pressure of the system and its increase up to 5-7 atm (73.5-102.9 PSI), led to a rise in the degree of cavitation development in water (FIG. 25). With a further increase in pressure, the degree of cavitation developed decreased.

Figure 26:
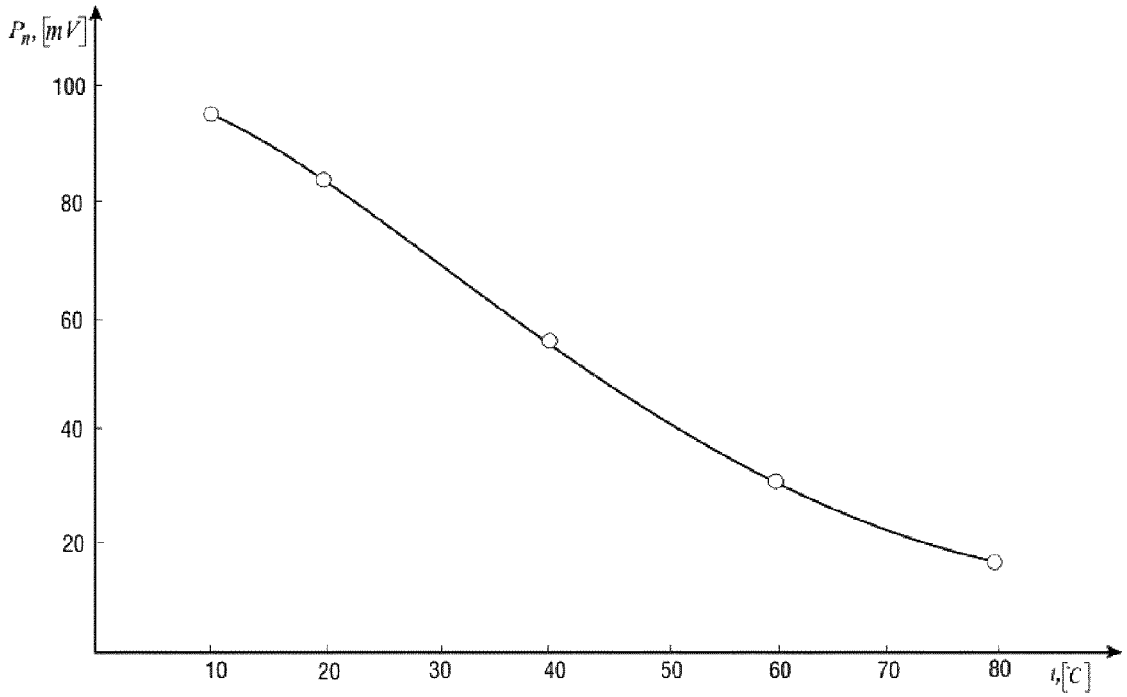
FIG. 26 shows the influence of temperature on the level of cavitation noise in water, when the liquid is subjected to EV.

The variation of water temperature in a preferred range of 20-80° C. (68-176° F.) also causes a change in the degree of cavitation development: for example, when the temperature was raised, the intensity of cavitation noise decreased (FIG. 26).

Figure 27:
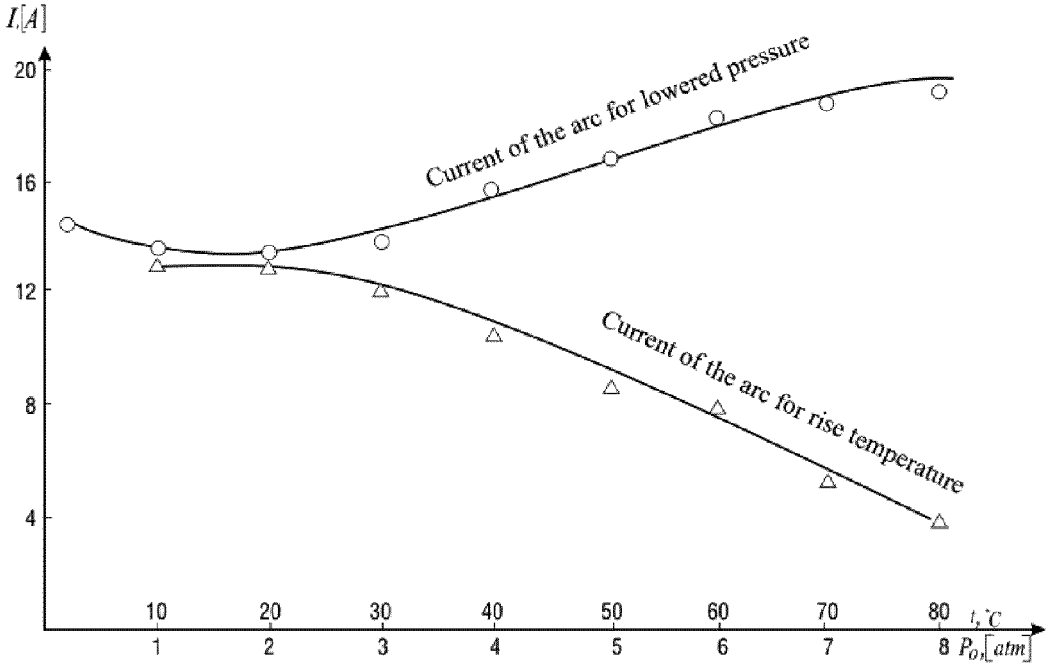
FIG. 27 shows the influence of static pressure and temperature on the discharge current, under conditions adequate for VSPD initiation within water.
Figure 28:
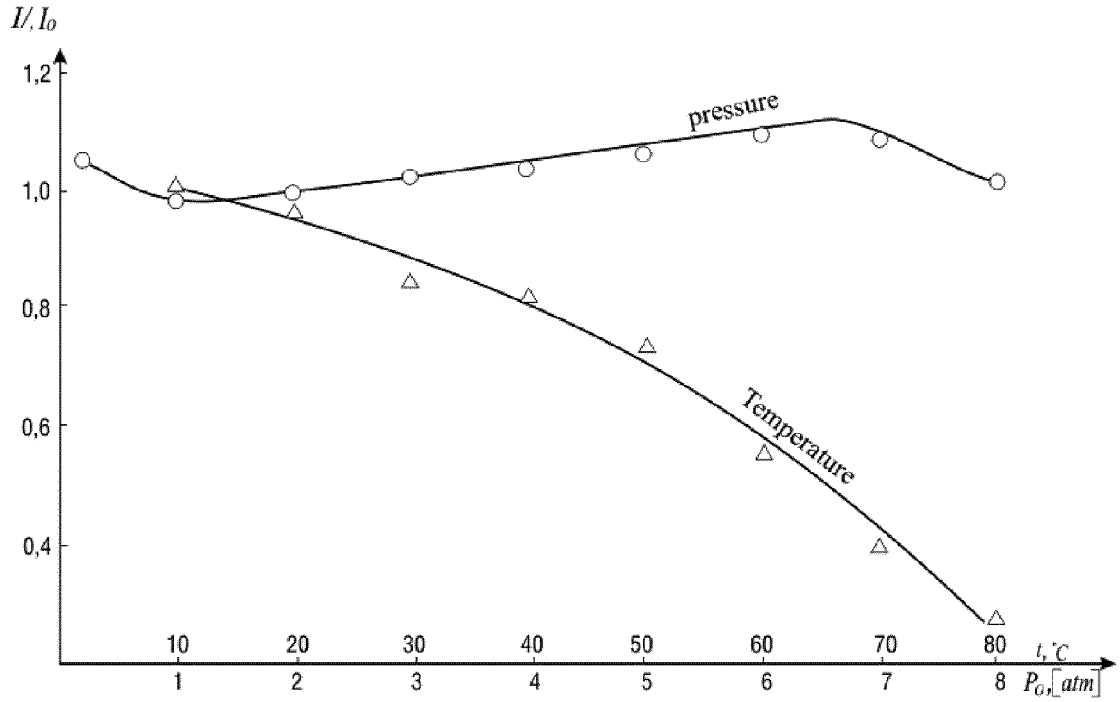
FIG. 28 shows the influence of static pressure and temperature of the medium, on the intensity of discharge glow in water.

The variation of static pressure in the system and the liquid phase temperature exerts some influence on electric and optical characteristics of VSPD within water (FIGS. 27 and 28). For example, the current of the arc, for stable glow, increased with a decrease in pressure below 1 atm and it rose in the range 3-7 atm. With a rise in temperature in the range 20-80° C. (68-176° F.), discharge current decreased.

Dependences between the intensity of discharge glow, and static pressure and temperature, have a qualitatively similar character. It should be noted that with a rise in the intensity of glow, its color shifts towards the blue-white frequency range.

Figure 29:
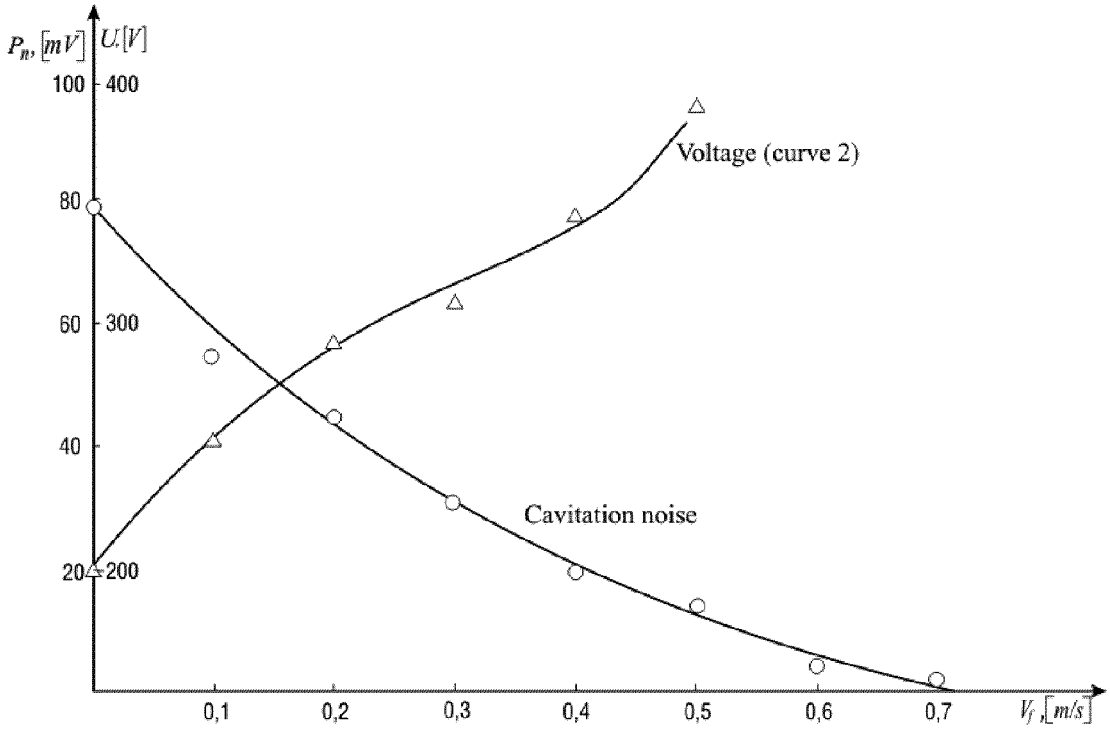
FIG. 29 shows the influence of the flow rate of liquid (water) on the level of cavitation noise, and on the minimum voltage for discharge glow (curve 2).

In the next series of experiments, the influence of the liquid flow rate on cavitation development within water was analyzed. The experiments were performed with an apparatus represented in FIG. 16 (a reflector was removed from the hydrodynamic radiator, and there were no mechanoacoustic vibrations in the reactor). The flow rate V in the interelectrode space varied in the range 0-0.7 mm/s. As a result of these experiments, it has been found that when increasing the flow rate, the level of cavitation noise decreases, and that at Vf>0.7 mm/s, cavitation within water practically does not occur (FIG. 29). Estimates showed that $Vf \geqq V_m$, where $V_m$ is the oscillatory velocity amplitude at $\xi_m = \xi_{m\ max}$. According to the observed character of a change in $P_n = f(V_f)$, the minimum voltage for stable glow discharge also increases.

Figure 30:
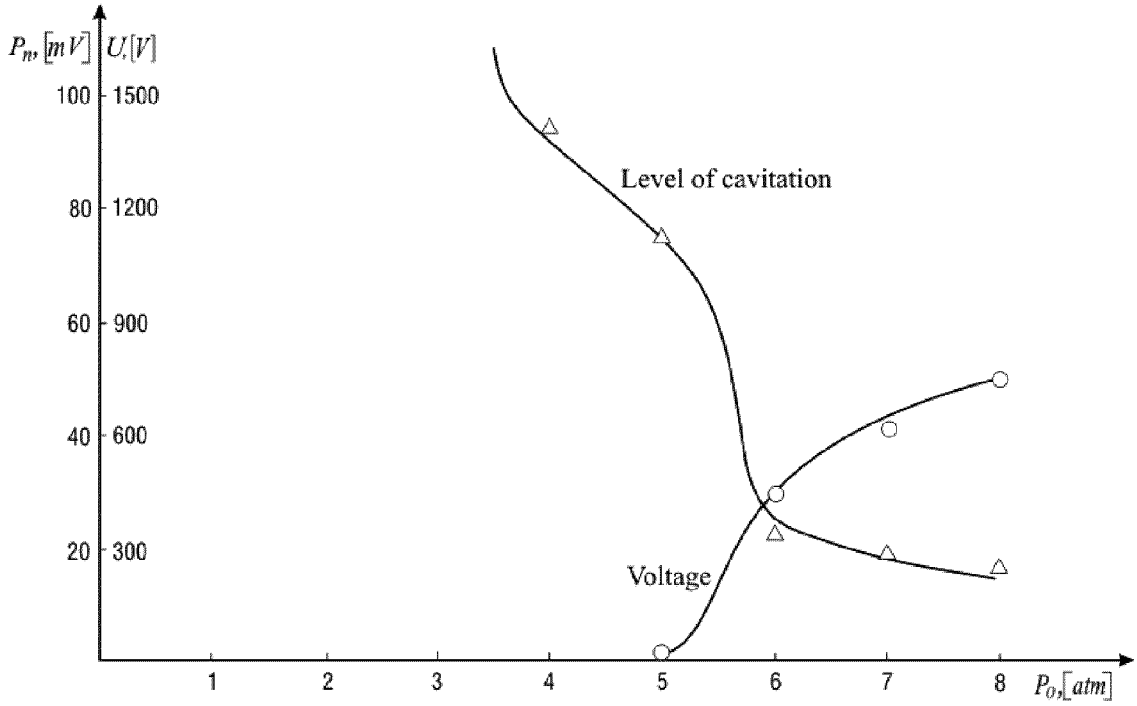
FIG. 30 shows the influence of static pressure (water flow rate) under conditions for the formation of the cavitation region, using a hydrodynamic radiator, on the level of cavitation noise, and on the minimum voltage of discharge glow.

Experiments using a hydrodynamic radiator for cavitation creation were conducted with the apparatus whose scheme is shown in FIG. 16. With a rise in pressure $P_o$, flow rate increased, and at $P_o$=6 atm (88.2 PSI), the cavitation region was formed in the interelectrode space when the level of cavitation noise was $P_{no}$=50 mV. With a rise in pressure $P_o$, the level of cavitation noise $P_n$ increased slightly. Electric and optical characteristics of VSPD varied accordingly, as shown in FIG. 30.

In another series of experiments, the influence of injecting a liquid phase into a blown gas flow was analyzed, generating EV with a gas-dynamic radiator (see FIG. 16). The blowing into a liquid phase was performed using air. To generate EV in gas flow, the pressure in the system of gas supply was maintained at the level $P_{og}$=6 atm (88.2 PSI). Experiments were also conducted where the reflector was removed from the gas-dynamic radiator and there were no EV in gas flow.

Figure 31:
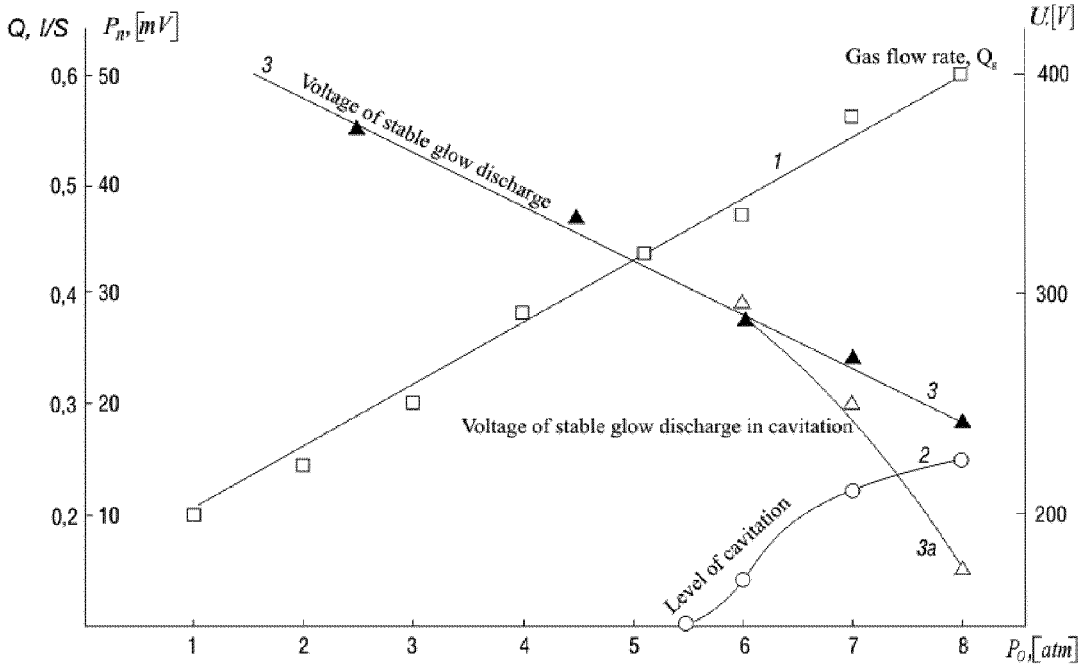
FIG. 31 shows the influence of blowing of a gas into the liquid phase, where EV is formed using a gas-dynamic radiator, on the flow rate of gas, the level of acoustic noise and the voltage for stable discharge glow, when EV in liquid is present and absent.

Turning to FIG. 31, experiments have shown that a rise in pressure $P_{og}$ causes an increase of gas flow rate $Q_g$ (curve 1). A rise in pressure above 6 atm (88.2 PSI), causes an increase of the noise within the liquid phase; this could be classified as noise from slightly developed cavitation phenomena (curve 2). Increasing the gas flow rate decreases the voltage of stable glow discharge (curve 3), the decrease being particularly abrupt when cavitation arises (curve 3*a*).

Therefore, according to the above described experiments, when a high-intensity ultrasonic field exceeding a cavitation threshold is induced within liquids, a new form of electric discharge is obtained, characterized by a volumetric glow electrical discharge throughout the space between the electrodes, having a rising volt-ampere characteristic curve that is inherent to abnormal glow discharge in gas.

Such discharge within the liquid having surface characteristics of micro bubbles can be of interest for the design of novel sonoplasma-chemical processes because of the extensive interface plasma: heterogeneous system liquid/gas-vapor should lead to a rise in diffusion rates of chemically active particles in the system.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims 1 regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

We claim:

1. An apparatus for volumetric abnormal glow sonoplasma discharge (VSPD) excitation within a liquid-phase working medium comprising a reactor, sources capable of providing an electric field and elastic vibrations within a working medium, and electrodes where the electric field source comprises two units, an ignition pulse unit for providing the voltage of an ignition pulse and a stable glow unit for providing the voltage for a stable glow volumetric sonoplasma discharge;

where the reactor comprises a radiating section of a vibration source, the vibrational source being introduced into the reactor filled with a working medium.

2. The apparatus according claim 1, where the reactor additionally comprises an electroacoustic transducer.

3. The apparatus according to claim 2, where the electroacoustic transducers operate in the frequency range of 5-40 kHz, inclusive, and is used as the source of elastic vibrations.

4. The apparatus according to claim 2, where the electroacoustic transducers are of the piezoceramic type operating in the frequency range 20-600 kHz, inclusive, and are used as the source of elastic vibrations.

5. The apparatus according claim 1, where the reactor additionally comprises a mechanoacoustic transducer.

6. The apparatus according to claim 5, where the mechanoacoustic transducer is of the hydro-dynamic type operating in the frequency range of 1-20 kHz, inclusive, and is used as the source of elastic vibrations.

7. The apparatus according to claim 5, where the mechanoacoustic transducer is the gas-dynamic type operating in the frequency range of 1-20 kHz, inclusive, and is used as the source of elastic vibrations.

8. The apparatus according claim 1, where the reactor additionally comprises a magnetostrictive transducer, where the magnetostrictive transducer operates in the frequency range of 5-40 kHz, inclusive, and is used as the source of elastic vibrations.

9. The apparatus according to claim 1, where the radiator has a diameter, where there is a reaction zone within the reactor, where the reaction zone has a length, where the distance between the electrodes and the radiating section of a vibration source ($L_{ei}$), the length of the reaction zone ($L_R$), the diameter of the radiator ($L_l$), and the distance between the electrodes themselves ($L_e$) are defined by the following:

$$L_e \cong L_{ei} \cong L_c$$

$$L_R \cong 1.2 L_l$$

$$L_c \cong (1.2\text{-}1.5)\lambda_{EV}$$

where $L_c$ is the parameter that characterizes the dimensions of a cavitation region, where the cavitation region is the extension into the liquid from the radiating section of a vibration source, and where $\lambda_{EV}$ is the wavelength of elastic vibrations that propagate into the working medium.

10. The apparatus according to claim 1, where at least one electrode is made in the form of a tube.

11. The apparatus according to claim 1, where at least one electrode is a structural component of the reactor.

12. The apparatus according to claim 1, where at least one electrode is the radiating section of the vibration source.

13. The apparatus according to claim 1, where the radiating section of the vibration source serves as a structural component for the reactor.

14. The apparatus according to claim 1, where the reactor comprises a flow regime, where the flow regime is of the continuous flow type.

15. The apparatus according to claim 1, where the reactor is provided with a means for withdrawal of a gas phase.

16. The apparatus according to claim 1, where the reactor is provided with a means for collection of a solid-phase sediment.

17. The apparatus according to claim 1, where the reactor has a means to coat a support with precipitated material, this support being the surface of an electrode.

18. The apparatus according to claim 1, where the reactor has a means to coat a support with precipitated material, this support being the surface of a radiator of elastic vibrations.

19. The apparatus according to claim 1, where the reactor additionally comprises a means for control and regulation of acoustic and electric parameters.

20. The apparatus according to claim 1, further comprising a capacitor battery, where the capacitor battery is the source of power for the ignition pulse unit, where the capacitor battery provides the difference of voltage and enough pulse duration for causing the breakdown of a liquid-vapor-gas working medium within the working medium, where the difference of voltage is in the range of 0.5-25 kV, inclusive, and has a pulse duration in the range of 0.1-100 μs, inclusive.

21. The apparatus according to claim 1, further comprising a high voltage source, where the high voltage source is the source of power for the ignition pulse unit, where the high voltage source provides the difference of voltage and enough pulse duration for causing the breakdown of a liquid-vapor-gas working medium within the working medium, where the difference of voltage is in the range of 0.5-25 kV, inclusive, and has a pulse duration in the range of 0.1-100 μs, inclusive.

22. The apparatus according to claim 1, where a source of direct current is used to provide a VSPD of stable glow, and a source of direct current is used to supply the voltage, in the range 30-2,000 Volts, inclusive, to provide a VSPD of stable glow.

23. The apparatus according to claim 1, where a source of alternating current of 50-100,000 Hz, inclusive is used to provide a VSPD of stable glow, and a source of alternating current of 50-100,000 Hz, inclusive, is used to supply the voltage, in the range 30-2,000 Volts, inclusive, to provide a VSPD of stable glow.

24. The apparatus according to claim 1, further comprising a source used for generation of electromagnetic radiation in the working medium, where the electromagnetic radiation is in the HF range (10-20 MHz) or UHF range (2-3 GHz) and with enough intensity for causing the electric breakdown of the working medium.

25. A method for the generation of volumetric abnormal glow sonoplasma discharge (VSPD) within a liquid-phase working medium, where the working medium is contained in a reactor, where the reactor comprises electrodes, comprising the steps of 1) applying an electric field to the working medium,
2) applying elastic vibrations to the working medium, and
3) initiating cavitation within the working medium conducted simultaneously or before applying an ignition voltage pulse to the electrodes, where the ignition voltage pulse is in the range of 0.5-30 kV, inclusive, with a duration within the limits of 0.1-100 μs, inclusive, whereby the method results in the excitation of an electrical discharge and thereby produces sonoplasma.

* * * * *